US007426365B2

(12) United States Patent
Uchihashi

(10) Patent No.: US 7,426,365 B2
(45) Date of Patent: Sep. 16, 2008

(54) WASTE TONER COLLECTING APPARATUS AND IMAGE FORMING APPARATUS

(75) Inventor: Satoru Uchihashi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 11/294,040

(22) Filed: Dec. 5, 2005

(65) Prior Publication Data

US 2006/0120779 A1 Jun. 8, 2006

(30) Foreign Application Priority Data

Dec. 7, 2004 (JP) ..... 2004-353915

(51) Int. Cl.
*G03G 21/00* (2006.01)

(52) U.S. Cl. ..... 399/358

(58) Field of Classification Search ..... 399/358
See application file for complete search history.

(56) References Cited

U.S. PATENT DOCUMENTS 5,021,825 A * 6/1991 Niki ..... 399/111
6,937,838 B2 * 8/2005 Ishii et al. ..... 399/358
2002/0114651 A1 * 8/2002 Wang ..... 399/358

FOREIGN PATENT DOCUMENTS

JP 60103366 A * 6/1985
JP 01316785 A * 12/1989
JP 04-127186 A 4/1992
JP 2005-316351 A 11/2005

* cited by examiner

*Primary Examiner*—Quana M Grainger
(74) *Attorney, Agent, or Firm*—Panitch Schwarze Belisario & Nadel LLP

(57) ABSTRACT

A toner-collecting apparatus collects waste toner therein. A toner collecting chamber holds the waste toner therein. The toner is directed into the toner collecting chamber through an inlet of the toner collecting chamber. A toner transporting member is located in the toner collecting chamber. The toner transporting member transports the toner received through the inlet into the toner collecting chamber. The toner transporting member includes a plurality of toner transporting sections. A first one of the plurality of toner transporting sections has a toner-transporting ability that changes in accordance with a condition of the toner held in the toner collecting chamber. The ability of the toner transporting member to transport the toner decreases with increasing a load exerted on the toner transporting member by the toner. The toner transporting member includes a shaft that extends toner collecting chamber and rotates about a longitudinal axis.

24 Claims, 17 Drawing Sheets

WASTE TONER COLLECTING APPARATUS AND IMAGE FORMING APPARATUS

BACKGROUND OF THE INVENTION

1. Field of the Invention

The present invention relates to a waste toner collecting apparatus and an image forming apparatus, and more particularly to a transporting mechanism that transports waste toner in a toner collecting chamber.

2. Description of the Related Art

Among image forming apparatuses are laser printers, facsimile machines, copiers, and the like that use an electrophotographic image forming process. An electrophotographic image forming process employs toner to develop an electrostatic latent image into a visible image or a toner image. After the toner image is transferred onto a print medium, some toner remains on the surface of a photoconductive drum. This residual toner is removed from the photoconductive drum and is collected into a toner collecting chamber provided within the electrophotographic image forming apparatus. One way of collecting waste toner is to allow the residual toner to fall by gravity into a toner collecting chamber. However, this way of collecting waste toner requires a toner chamber to extend vertically so that the toner chamber has a sufficient volume to accommodate the residual toner. This often places some limitations on efficient utilization of space in the image forming apparatus. Another way of collecting the waste toner is to transport the collected residual toner in a horizontal toner chamber. This requires a waste toner transporting mechanism (e.g., a spiral) in the horizontal chamber.

However, if the waste toner transporting mechanism has the ability to transport the toner across its length in the toner chamber, the waste toner tends to pile up at a downstream space with respect to the direction of travel of the waste toner while an upstream space is still capable of holding the waste toner. Thus, the waste toner at the downstream space is over packed to exert an extremely large load on the waste toner transporting mechanism, failing to hold any more waste toner in the chamber.

Likewise, if the waste toner transporting mechanism has the ability to transport the toner only part of its length along the toner chamber, the waste toner will not reach the downstream space, so that the downstream space is not effectively used to hold the waste toner.

SUMMARY OF THE INVENTION

An object of the invention is to solve the problem that non-uniform density distribution in a waste toner holding chamber deteriorates the ability of toner holding chamber to accommodate toner.

Another object of the invention is to provide a toner collecting apparatus that can accommodate as large an amount of waste toner as the toner collecting apparatus is designed, and an image forming apparatus that employs the toner collecting apparatus.

A toner-collecting apparatus is used to collect waste toner. A toner collecting chamber holds toner therein. The chamber receives the waste toner through an inlet. A toner transporting member is located in the toner collecting chamber. The toner transporting member transports the toner in the toner collecting chamber. The toner transporting member includes a plurality of toner transporting sections. A first one of the plurality of toner transporting sections has a toner-transporting ability that changes in accordance with a condition of the toner held in the toner collecting chamber.

The toner transporting member extends in the toner collecting chamber from upstream to downstream with respect to a direction in which the toner is transported in the toner collecting chamber. The first one of the plurality of toner transporting sections extends from a substantially downstream end of the toner transporting member to an upstream portion of the toner transporting member.

The ability of the toner transporting member to transport the toner decreases with increasing load on the toner transporting member exerted by the toner.

The toner transporting member includes a shaft that extends in the toner collecting chamber and rotates about a longitudinal axis.

The toner transporting member includes an engagement portion fixed on the shaft. The first one of the plurality of toner transporting sections includes a toner transporting element that is in frictional contact with the engagement portion so that rotation of the shaft is transmitted to the toner transporting element through a frictional force.

The toner transporting element is a coil spring through which the shaft extends, the coil spring urges against the engagement portion to create the frictional force.

The toner transporting element is coupled to a second one of the plurality of transporting sections via a ratcheting mechanism provided between the boundary of the first one of the plurality of transporting sections and the second one of the plurality of transporting sections. Rotation of the second one of the plurality of transporting sections is transmitted to the first one of the plurality of transporting sections through the ratcheting mechanism.

The toner transporting element is a coil spring through which the shaft extends, the coil spring urges the ratcheting mechanism into an engagement state in which rotation of the second one (54*c*) of the plurality of transporting sections is transmitted to the first one of the plurality of transporting sections.

The first one of the plurality of transporting sections includes a spiral screw that spirals on the shaft.

The first one of the plurality of transporting sections is connected to a second one of the plurality of transporting sections via a portion having a smaller mechanical strength than any of the first one of the plurality of transporting sections and the second one of the plurality of transporting sections. The portion fractures when the first one of the plurality of transporting sections receives a torque load greater than a certain value during rotation of the toner transporting member.

The toner transporting member includes an engagement portion fixed on the shaft. The first one of the plurality of toner transporting sections includes a coil spring having one end connected to the engagement portion so that the coil spring is rotatable together with the shaft. The coil spring is compressed as a torque load exerted by the toner increases.

The first one of the plurality of transporting sections and a second one of the plurality of transporting sections are coupled through a coil spring that is in friction engagement with the first one of the plurality of transporting sections and the second one of the plurality of transporting sections such that rotation of the second one of the plurality of transporting sections is transmitted to the first one of the plurality of transporting sections through the coil spring. When the second one of the plurality of transporting sections rotates, the rotation is transmitted to the first one of the plurality of transporting sections so that a force acts on the coil spring in such a direction as to unwind the coil spring.

A toner-collecting apparatus is used to collect waste toner. A toner collecting chamber holds toner therein. The toner collecting chamber receives the waste toner through an inlet. A toner transporting member is located in the toner collecting chamber. The toner transporting member transports the toner received through the inlet into the toner collecting chamber. A direction switching section switches a direction in which toner transporting member transports the toner in the toner collecting chamber.

The toner transporting member has a toner-transporting ability that changes in accordance with a condition of the toner held in the toner collecting chamber.

The toner-transporting ability is constrained in a specific direction.

The toner transporting member includes a shaft that extends in the toner collecting chamber and rotates about a longitudinal axis. A toner transporting element is formed about the shaft, the toner transporting element transporting the toner when the shaft rotates.

The direction switching section includes a drive motor that drives the shaft in rotation. A load detecting section detects a torque load exerted on the shaft. The direction switching section switches a direction in which the drive motor rotates, the direction being switched depending on the torque load detected by the load detecting section.

The load detecting section detects the torque load based on a rotational speed of the shaft.

The toner transporting member includes a toner transporting section provided at least in the vicinity of the inlet.

An image forming apparatus incorporates the aforementioned toner collecting apparatus. The image apparatus includes a toner transporting mechanism that collects toner scraped off from a photoconductor on which a toner image is formed. The toner collecting apparatus receives the toner discharged from the toner transporting mechanism, the toner being received through an inlet of the toner collecting apparatus.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

First Embodiment

Figure 1:
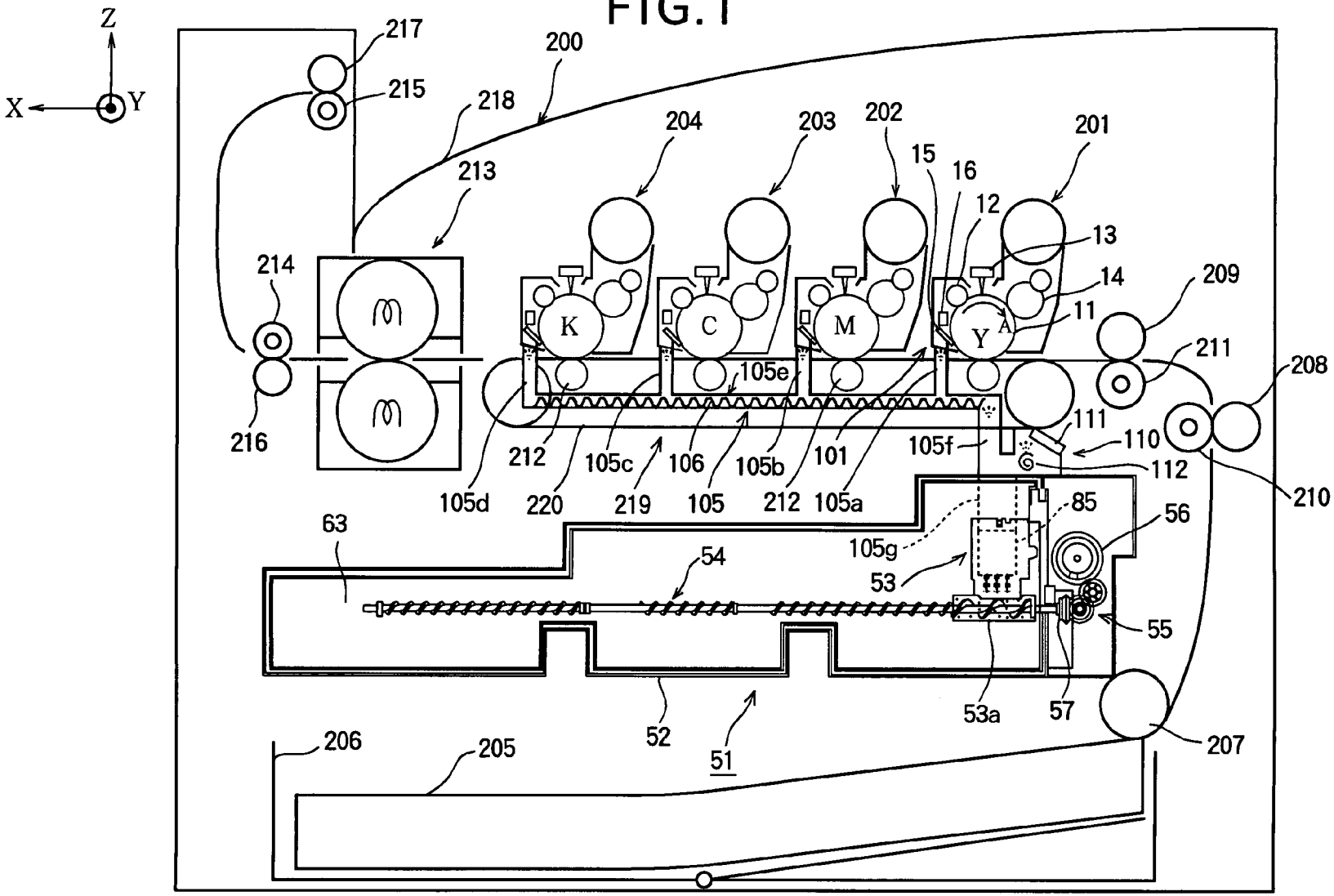
FIG. 1 is a schematic diagram illustrating an electrophotographic image forming apparatus having a waste toner collecting apparatus according to a first embodiment.

FIG. 1 is a schematic diagram illustrating an electrophotographic image forming apparatus having a waste toner collecting apparatus according to a first embodiment.

Referring to FIG. 1, an image forming apparatus 200 includes process units 201-204 that form yellow (Y), magenta (M), cyan (C), and black (K) images. The process units 201-204 are detachably attached to the image forming apparatus 200, and are aligned in this order from upstream to downstream along the transport path of a recording medium. Each of the process units 201-204 may be substantially identical; for simplicity only the operation of the process unit 201 for forming yellow images will be described, it being understood that the other cartridges 20 may work in a similar fashion.

The process unit 201 includes a photoconductive drum 11 that is rotatable in a direction shown by an arrow A. Disposed around the photoconductive drum 11 are a charging roller 12, an exposing unit 13, a developing roller 14, a cleaning blade 15, and a neutralizing device 16, which are aligned in this order from upstream to downstream with respect to the rotation of the photoconductive drum 11. The charging roller 12 rotates in contact with the photoconductive drum 11 to charge the surface of the photoconductive drum 11. In accordance with print data, the exposing unit 13 illuminates the charged surface of the photoconductive drum 11 to form an electrostatic latent image. The developing roller 14 deposits a yellow toner to the electrostatic latent image formed on the photoconductive drum 11 to develop the electrostatic latent image into a toner image. The cleaning blade 15 removes residual toner that remains on the surface of the photoconductive drum 11 after transferring the toner image. The neutralizing device 16 removes residual charges from the photoconductive drum 11. The aforementioned drum and rollers are driven in rotation through gears by a drive source, not shown.

The image forming apparatus 200 includes a paper cassette 206 at a lower portion of the image forming apparatus 200, the paper cassette 206 holding a stack of recording medium 205 such as paper. A hopping roller 207 is disposed over the paper cassette 206 and feeds the recording medium 205 on a page-by-page basis. A transport roller 210 is disposed downstream of the hopping roller 207 with respect to the transport path of the recording medium to the process unit 201, and cooperates with a pinch roller 208 to transport the recording medium 205 while holding the recording medium 205 in a sandwiched relation between the transport roller 210 and the pinch roller 208. A registration roller 211 cooperates with a pinch roller 209 to remove skew of the recording medium 205 with the transport path immediately before the recording medium 205 is fed into the process unit 201. The hopping roller 207, transport roller 210, and registration roller 211 are driven in rotation through gears by a drive source, not shown.

Transfer rollers 212 are made of, for example, an electrically conductive rubber and are disposed to oppose the photoconductive drums 11 of the process units 201-204. The transfer rollers 212 receive a high voltage to create a potential difference between each of the transfer rollers 212 and corresponding photoconductive drums 11 when the toner image is transferred onto the recording medium 205.

A fixing unit 213 includes a heat roller and a backup roller, which cooperate with each other to apply heat and pressure to the toner image on the recording medium 205, thereby forming a permanent image on the recording medium 205. Discharge rollers 214 and 215 cooperate with pinch rollers 216 and 217, respectively, to hold the recording medium 205 in a sandwiched relation and transport the recording medium 205 to a stacker 218. The fixing unit 213, discharge rollers 214 and 215, and pinch rollers 216 and 217 are driven in rotation through gears by a drive source, not shown. A belt unit 219 forms a transport path through which the recording medium 205 passes through the process units 201-204. A belt 220 is sandwiched between the photoconductive drums 11 and corresponding transfer rollers 212, and transports the recording medium 205 to the fixing unit 203.

The operation of the image forming apparatus 200 will be described.

The hopping roller 207 separates a top page of the recording medium 205 from the stack of the recording medium 205, and feeds the top page into the transport path. The recording medium 205 is then transported to an entrance of the belt unit 219 while being held by the transport roller 210, registration roller 211, and pinch rollers 208 and 209. Then, the recording medium 205 is transported by the belt unit 219 to the process unit 201 where a yellow toner image is transferred from the photoconductive drum 11 onto the recording medium 205.

Likewise, the recording medium 205 passes through the process units 202-204 in sequence so that toner images of the respective colors are transferred onto the recording medium 205 one over the other in registration. The toner images of the respective colors carried on the recording medium 205 are fixed into a full color permanent image. Then, the recording medium 205 is discharged by the discharge rollers 214 and 215 and the pinch rollers 216 and 217 onto the stacker 218.

Referring to FIG. 1, an X-axis is parallel to a direction in which the recording medium 205 is transported through the process units 201-204, a Y-axis is perpendicular to the X-axis, and a Z-axis is perpendicular to the X-axis and Y-axis.

The configuration and operation of the image forming apparatus for collecting waste toner will be described.

Disposed below the cleaning blade 15 of the process unit 201 is a toner collecting section 101 through which the waste toner is directed to a toner transporting mechanism 105. The collecting section 101 for each of the process units 201-204 may be substantially identical; for simplicity only the operation of the collecting section 101 for the process unit 201 for forming yellow images will be described, it being understood that the other collecting sections may work in a similar fashion.

Figure 3:
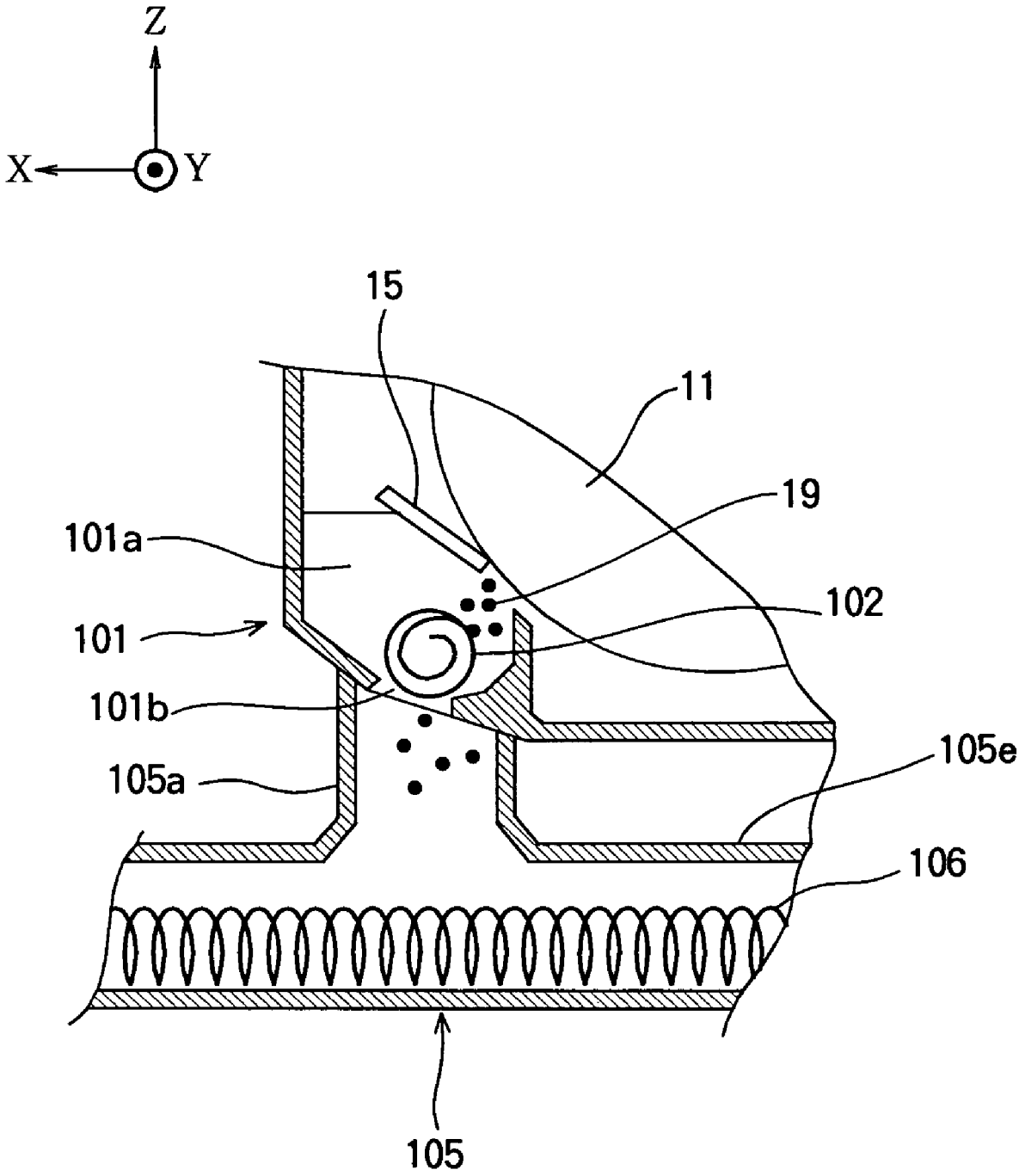
FIG. 3 is a fragmentary enlarged cross-sectional view of the vicinity of a collecting section.

FIG. 3 is a fragmentary enlarged cross-sectional view of the vicinity of the collecting section 101. Referring to FIG. 3, the cleaning blade 15 extends across substantially the entire length of the photoconductive drum 11 that extends in the Y-axis. The cleaning blade 15 engages the surface of the photoconductive drum 11 to scrape off the residual toner in such a way that the residual toner falls by gravity into the collecting space 101*a*. A screw conveyer 102 has a rotational shaft that extends in the Y-axis in the collecting space 101*a*, and extends substantially across the length of the cleaning blade 15. The screw conveyer 102 is driven in rotation by a drive source, not shown. A toner exit 101*b* is formed below the end portion of the collecting section 101 in the Y-axis.

The waste toner 19 scraped off by the cleaning blade 15 falls by gravity into the collecting space 101*a* and is transported in the collecting space 101*a* by the screw conveyer 102 in a direction parallel to the Y-axis (toward the reader). Then, the waste toner 19 reaches the toner exit 101*b* through which the waste toner falls into a toner guide 105*a*.

Referring to FIG. 1, the toner transporting mechanism 105 is disposed at one end portion of the Y-axis (on the reader's side of FIG. 3). The toner transporting mechanism 105 includes toner guides 105*a*-105*d* and a toner transporting path 105*e*. The toner guides 105*a*-105*d* communicate with corresponding toner exits 101*b* (FIG. 3), and receive the waste toner 19 that falls by gravity from the toner collecting section 101. The toner guides 105*a*-105*d* extends in the Y-axis. The toner transporting path 105*e* communicates with the toner guides 105*a*-105*d*, and extends in the X-axis. A spiral 106 extends in the transporting path 105*e*, and is rotated about its longitudinal axis by a drive source, not shown, so as to transport the waste toner 19 in the X-axis (rightward in FIG. 1).

The toner transport mechanism 105 includes a toner discharging port 105*f* provided at its one longitudinal end portion, and a toner guide 105*g*. The toner discharging port 105*f* communicates with the toner guide 105*g* such that the waste toner 19 falls by gravity into the toner guide 105*g* through the discharging port 105*f*. The toner guide 105*g* guides the waste toner 19 into a chamber 52 of a waste toner collecting apparatus 51. The waste toner collecting apparatus 51 is detachably attached to the image forming apparatus 200.

The toner transporting mechanism 105 includes a belt-cleaning member 110 that scrapes the waste toner from the transfer belt 220, and a spiral 112 that transports the waste toner scraped off by the belt-cleaning member 110 into the toner guide 105*g*.

As described above, the waste toner 19 gathered into the toner guide 105*g* is then accommodated into the chamber 52 of the waste toner collecting apparatus 51.

Figure 2:
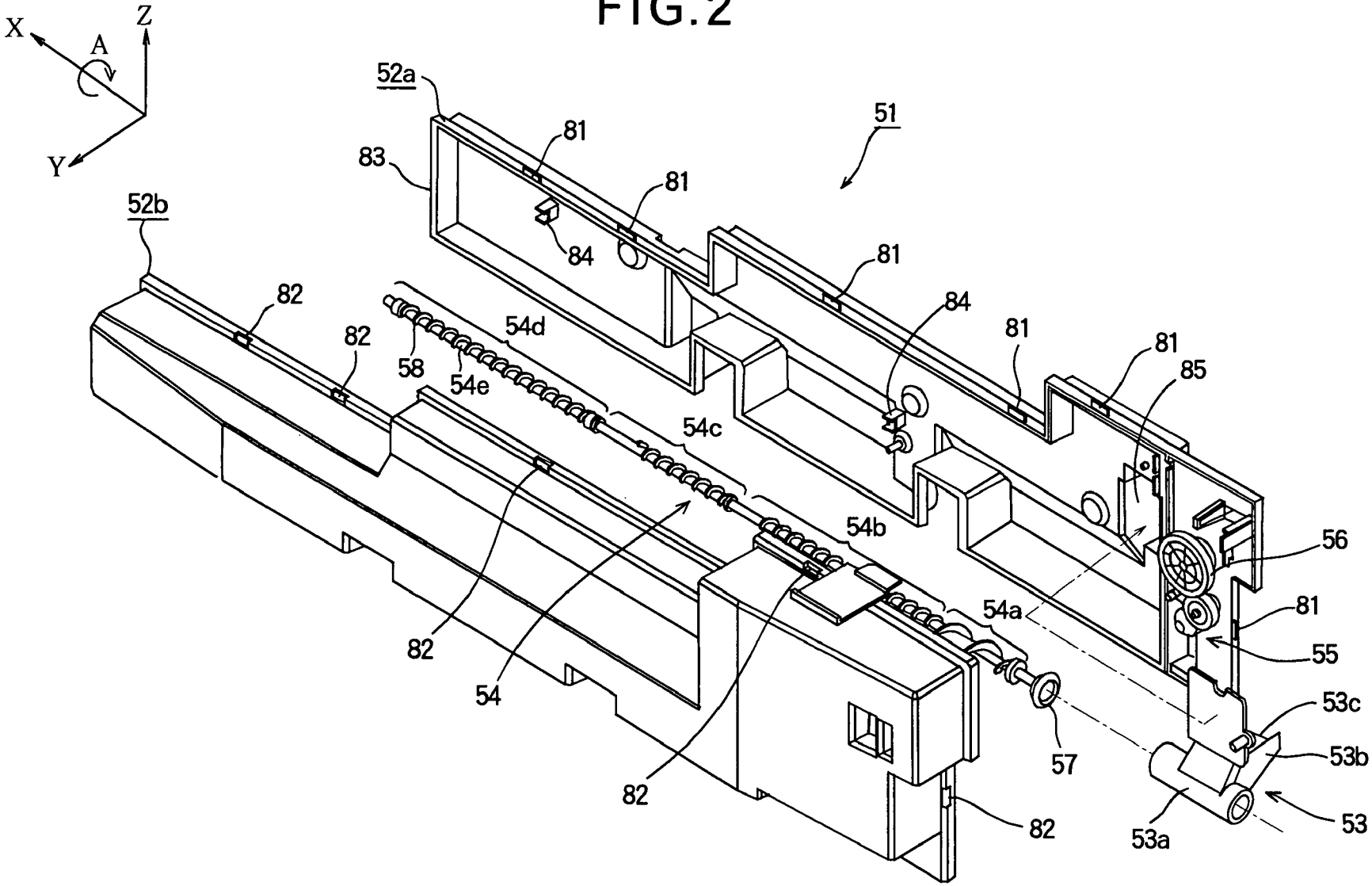
FIG. 2 is an exploded perspective view illustrating the configuration of the waste toner collecting apparatus.

The configuration and operation of the waste toner collecting apparatus 51 will be described. FIG. 2 is an exploded perspective view illustrating the configuration of the waste toner collecting apparatus 51.

Referring to FIGS. 1 and 2, the waste toner collecting apparatus 51 includes the chamber 52, an inlet 53, a spiral 54, a gear train 55 that drives the spiral 54 in rotation, and a coupling 56 that transmits the drive force from a drive motor to the gear train 55. The chamber 52 includes a half shell 52*a* and a half shell 52*b* as shown in FIG. 2. The half shelves 52*a* and 52*b* are fitted together through fitting portions, not shown, formed at lower portions of the half shelves 52*a* and 52*b*. The half shelves 52*a* and 52*b* also engage each other through tongues 81 formed on the half shell 52*a* and recesses 82 formed in the half shell 52*b*. The half shelves 52*a* and 52*b* are fitted together to define a toner holding space 63 therein. A sealing member 83 is sandwiched between the half shelves 52*a* and 52*b* to improve sealing effect of the toner holding space 63 against the environment.

The chamber 52 includes bearings 84 formed on the half shelves 52*a* and 52*b* such that when the half shelves 52*a* and 52*b* are assembled together, the bearings 84 oppose each other to cooperate with each other to rotatably support the spiral 54 at two locations in the toner holding space 63.

The inlet 53 is fitted to an opening 85 in the half shell 52*a* with its cylindrical sleeve 53*a* receiving a guide portion 54*a* of the spiral 54. At this moment, a projection 53 of the inlet 53 projects outwardly of the chamber 52, so that when the waste toner collecting apparatus 51 has been fitted to the image forming apparatus 200, the projection 53*b* abuts the toner guide 105*g* of the toner transporting mechanism 105. A toner receiving port 53*c* is an opening formed in the projection 53*b*, and communicates with the cylinder 53*a*.

When the waste toner collecting apparatus 51 has been attached into the image forming apparatus 200, the spiral 54 extends in the X-axis so that one end portion of the spiral 54 projects outwardly of the chamber 52. This end portion has a gear 57 that is in mesh with the gear train 55. The toner transporting member or spiral 54 also includes the guide portion 54*a*, a spiral portion 54*b*, a first toner transporting section or spiral portion 54*c*, and a free end portion 54*d*.

A description will now be given of the coupling between the toner transporting mechanism 105 and the waste toner collecting apparatus 51 when the waste toner collecting apparatus 51 is attached to or detached from the image forming apparatus 200.

Figure 4A:
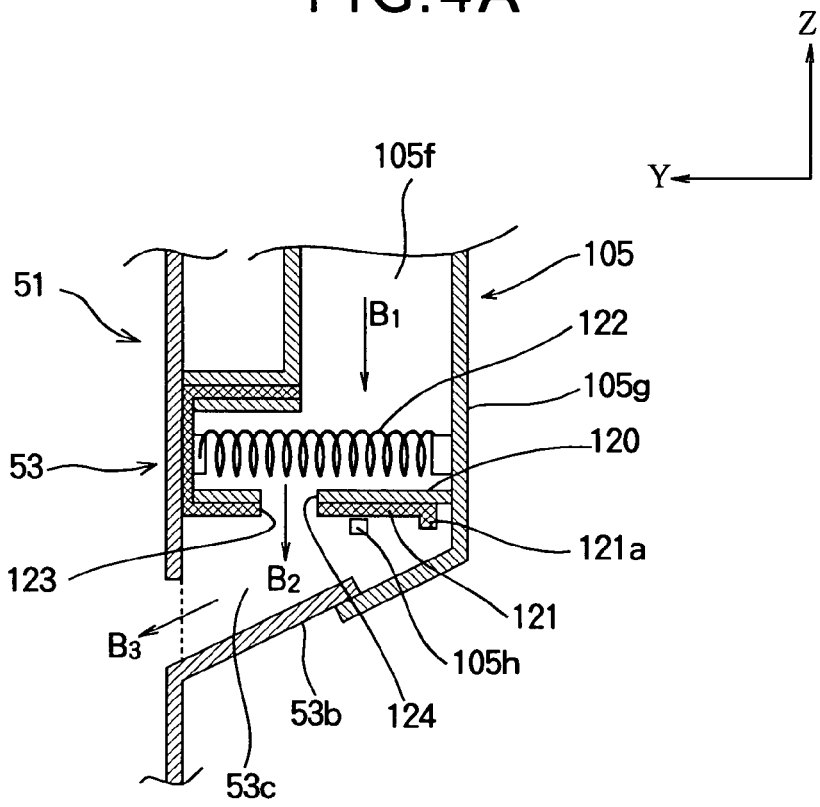
FIGS. 4A and 4B are fragmentary enlarged views of a coupling relation between a toner guide of a toner transporting mechanism and an inlet of the waste toner collecting apparatus.
Figure 4B:
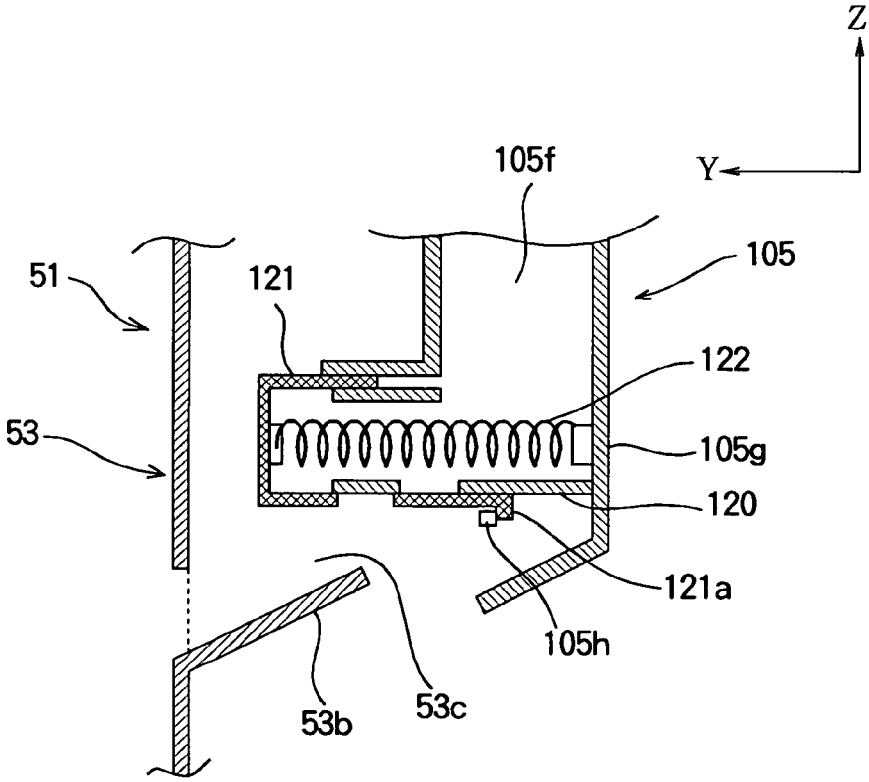

FIGS. 4A and 4B are fragmentary enlarged views of a coupling relation between the toner guide 105*g* of the toner transporting mechanism 105 and the inlet 53 of the waste toner collecting apparatus 51. FIG. 4A is a fragmentary cross-sectional view illustrating the coupling relation when the waste toner collecting apparatus 51 has been attached into the image forming apparatus 200. FIG. 4B is a fragmentary cross-sectional view illustrating the coupling relation when the waste toner collecting apparatus 51 has been detached from the image forming apparatus 200.

The toner guide 105*g* includes a fixed cap 120 that engages a movable cap 121 in such a way that the movable cap 121 fits over the fixed cap and is slidable relative to the fixed cap 120.

Figure 5:
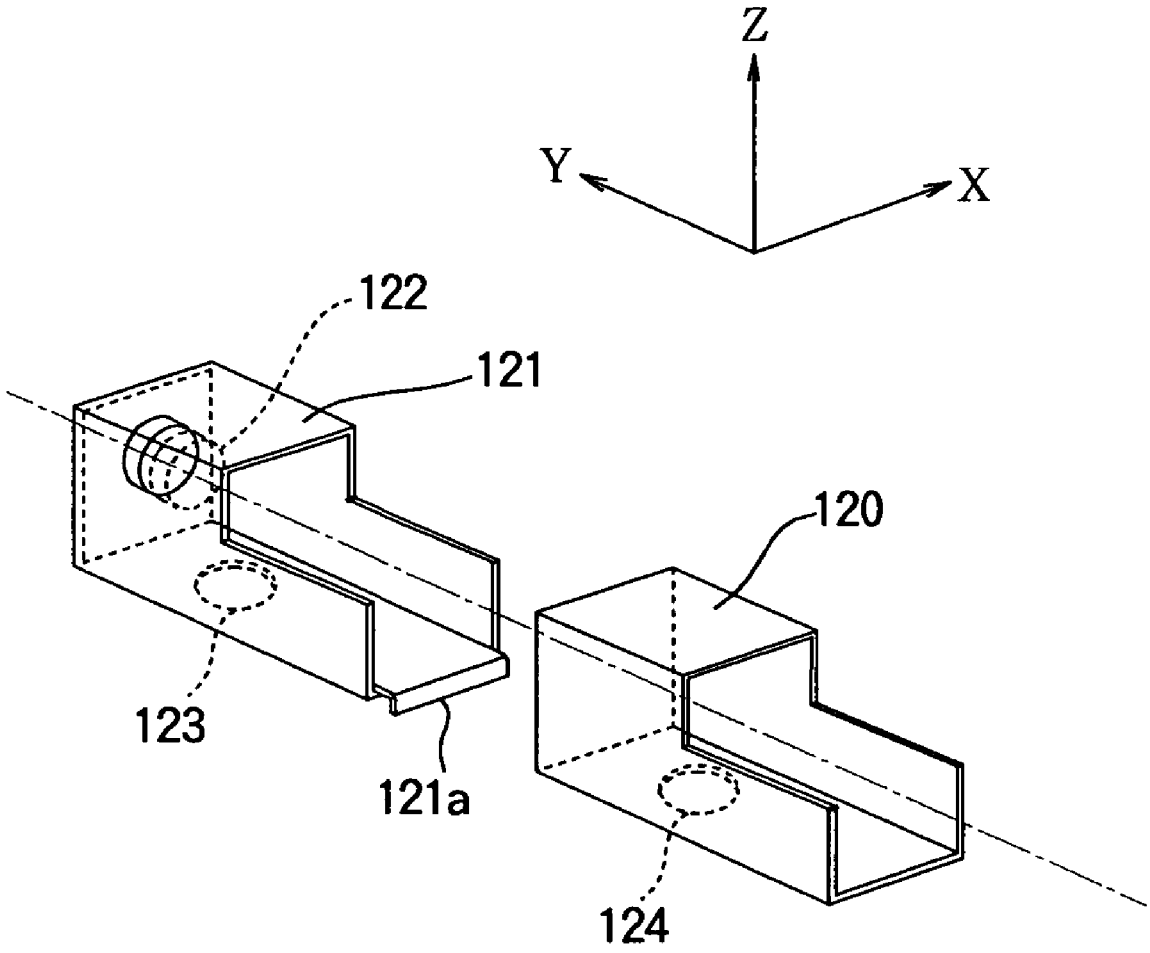
FIG. 5 is a perspective view illustrating a fixed cap and a movable cap.

FIG. 5 is a perspective view illustrating the fixed cap 120 and the movable cap 121. The movable cap 121 is supported so that the movable cap 121 loosely fits over the fixed cap 120 and is slidable in the Y-axis. The movable cap 121 is biased by a compressed coil spring 122 such that the movable cap 121 is movable relative to the fixed cap 120.

Referring back to FIG. 4A, the fixed cap 120 and the movable cap 121 are formed with an opening 124 and an opening 123, respectively, such that when the waste toner collecting apparatus 51 has been attached to the image forming apparatus 200, the openings 123 and 124 are in line with each other. The movable cap 121 is formed with a projection 121*a*. As shown in FIG. 4B, the toner guide 105*g* is formed with a stopper 105*h*. When the waste toner collecting apparatus 51 has been detached from the image forming apparatus 200, the stopper 105*h* engages the projection 121*a* at a position where the fixed cap 120 closes the opening 123 and the movable cap 121 closes the opening 124.

With the aforementioned coupling relation between the waste toner collecting apparatus 51 and toner transporting mechanism 105, when the waste toner collecting apparatus has been attached to the image forming apparatus 200, the waste toner 19 falls through the toner discharging port 105*f* of the toner transporting mechanism 105. Then, the waste toner 19 passes through the openings 123 and 124 as shown by arrows B1-B3 (FIG. 4A), and then through the toner receiving port 53*c* of the inlet 53 into the cylindrical sleeve 53*a* (FIG. 1) of the inlet 53.

When the waste toner collecting apparatus 51 has been detached from the image forming apparatus 200, the movable cap 121 slides in the Y-axis to a position where the movable cap 121 is stopped by the stopper 105*h*. At this moment, the movable cap 121 is at a position where the fixed cap 120 closes the opening 123 and the movable cap 121 closes the opening 124. Therefore, the toner guide 105*g* of the toner transporting mechanism 105 is sealed, so that the waste toner 19 stays within the toner guide 105*g* and will not leak into the inner space of the image forming apparatus 200.

Although the coil spring 122 in the above example has been described as merely urging the movable cap 121, the coil spring may be configured such that the coil spring rotates about its longitudinal axis (Y-axis) to transport the waste toner 19 toward the openings 123 and 124.

The spiral 54 in FIG. 2 includes the guide portion 54*a*, the spiral portion 54*b*, the spiral portion 54*c*, and a shaft 54*e* of the free end portion 54*d*, which are molded from a plastic material.

Figure 6:
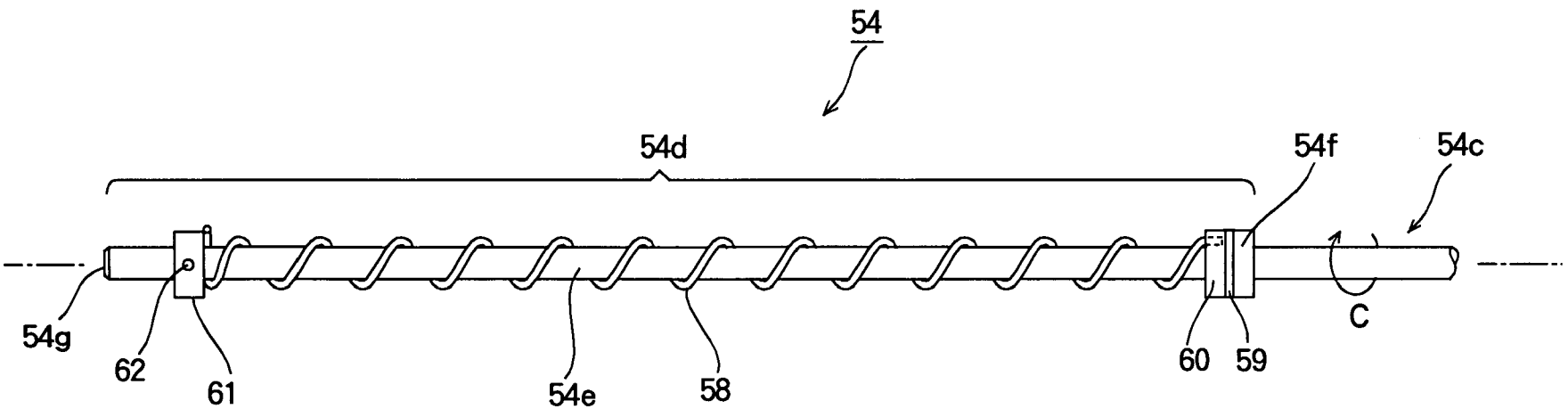
FIG. 6 is a fragmentary enlarged view of a spiral.

FIG. 6 is a fragmentary enlarged view of the spiral 54. Referring to FIG. 6, the free end portion 54*d* includes a force transmitting section that is comprised of a flange 54*f* formed in one piece with the shaft 54*e* and a washer 59. The free end portion 54*d* also includes a second toner transporting section or a coil spring 58, a fixed stopper 61, and an engagement piece 60 slidably mounted on the shaft 54*e*. The shaft 54*e* extends through the coil spring 58. The coil spring 58 has one end secured to the engagement piece 60 and another end abuts the fixed stopper 61 such that the coil spring 58 is slidable on the surface of the stopper 61. The stopper 61 is secured to the shaft 54*e* at a position somewhat away from an end 54*g* by means of a knock pin 62. In other words, the coil spring 58 and engagement piece 60 are integral with each other, and are positioned between the flange 54*f* and stopper 61 with the coil spring 58 compressed.

The operation of the waste toner collecting apparatus 51 of the aforementioned configuration will be described.

Figures 7A, 7B, 7C:
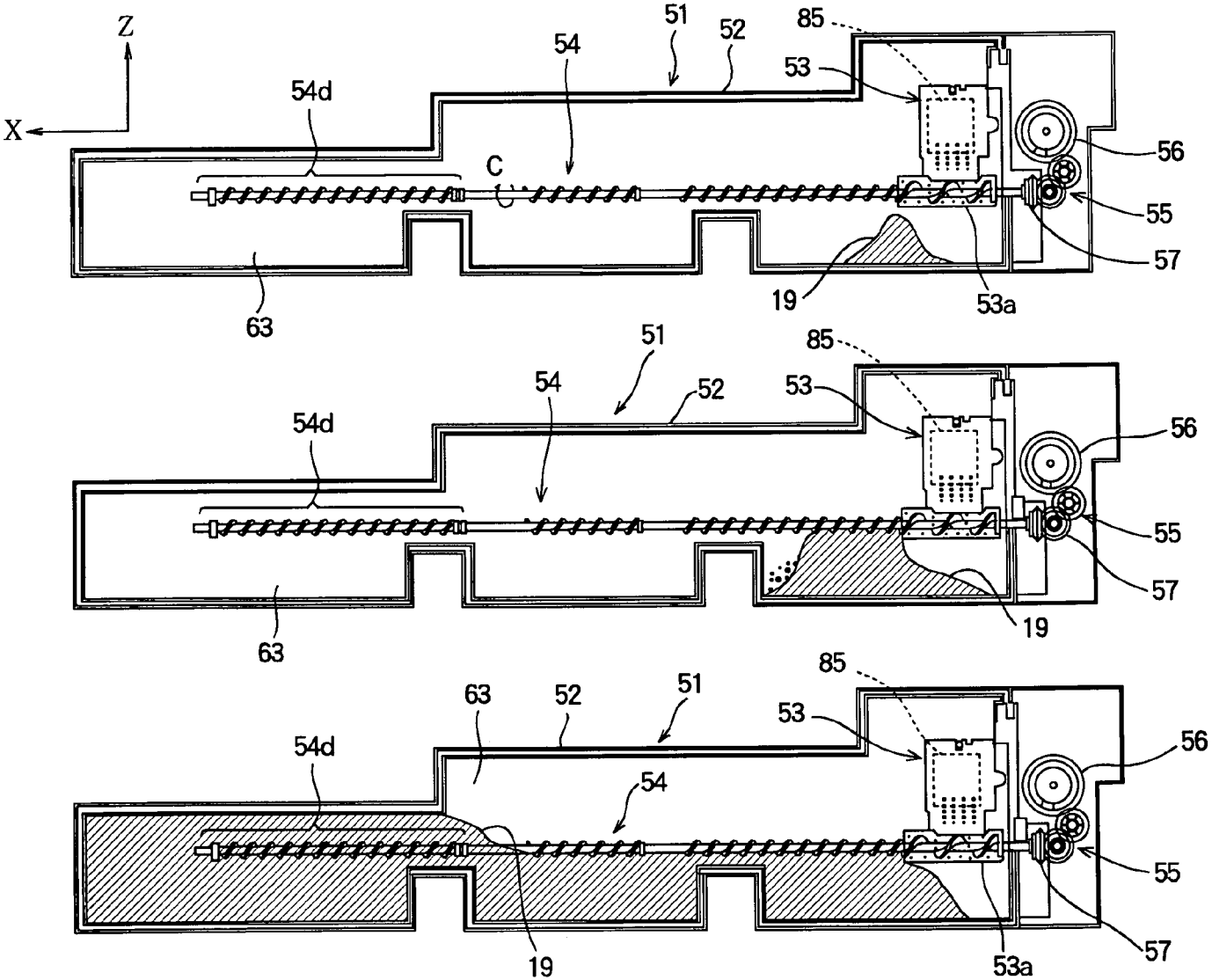
FIGS. 7A-7C are front views illustrating the waste toner collecting apparatus at different levels of the toner.

FIGS. 7A-7C are front views illustrating the waste toner collecting apparatus 51 at different levels of the waste toner 19.

Referring to FIG. 7A, the waste toner 19 is discharged from the toner transporting mechanism 105 (FIG. 1), and falls into the cylindrical sleeve 53*a*. At this stage, the spiral 54 is driven by a drive source, not shown, to rotate in a direction shown by arrow C (FIGS. 6 and 7A) to transport the waste toner 19 into the toner holding space 63.

Thus, the waste toner 19 is transported in the cylindrical sleeve 53*a* to be discharged to the outside. Referring to FIG. 7A, when the toner holding space 63 is nearly empty, the waste toner 19 discharged from the cylindrical sleeve 53*a* falls toward the bottom of the toner holding space 63 and will pile up at the bottom gradually.

When the top of the pile of the waste toner 19 reaches the spiral 54, the spiral 54 moves the top portion of the pile of the waste toner 19 little by little toward the back end portion of the toner holding space 63. Then, the waste toner 19 will eventually reach the free end portion 54*d* of the spiral 54. The coil spring 58 on the free end portion 54*d* rotates to move the waste toner 19 further toward the back end of the toner holding space 63.

The waste toner 19 will eventually reaches the back end of the toner holding space 63 as shown in FIG. 7C, and therefore the density of the waste toner 19 will increase gradually in the vicinity of the back end of the toner holding space 63. As the density of the waste toner 19 increases, the torque load on the coil spring 58 (FIG. 6) will increase. When the torque load exerted on the coil spring 58 exceeds a certain value, the second toner transporting section of the free end portion 54*d* of the spiral 54 stops transporting the waste toner 19.

In other words, when the density of the waste toner at the back end portion of the toner holding space 63 exceeds a certain value, the waste toner 19 exerts a torque load on the coil spring 58 larger than the friction force between the flange 54*f* and the washer 59 or the friction force between the engagement piece 60 and the washer 59. As a result, the spring 58 stops rotating, so that the waste toner 19 is no longer transported to the back end portion of the toner holding space 63.

Although the first embodiment has been described with respect to the coil spring 58 mounted only on the free end portion 54*d* of the spiral 54, a similar coil spring may also be mounted on the spiral portion 54*b* and/or the spiral portion 54*c*.

While the spiral portions 54*b* and 54*c* have been described as being made of a plastic material with screws formed around the shaft 54*e*, the spiral portions 54*b* and 54*c* may also be implemented by using a coil spring integrally mounted on the shaft 54*e* so that the coil spring rotates together with the shaft 54*e*.

According to the aforementioned waste toner collecting apparatus 51, when the density of the waste toner 19 at the back end portion of the toner holding space 63 exceeds a certain value, the spiral portion 54*d* stops transporting the waste toner 19. This prevents the drive sources such as a drive motor from being overloaded, thereby preventing the failure of the toner holding space 63 to accommodate the waste toner 19 which would otherwise occur if the spiral 54 is stopped due to overload.

The friction force between the flange 54*f* and the washer 59 and/or the friction between the engagement piece 60 and the washer 59 causes the coil spring 58 to rotate, and the coil spring 58 rotates to transport the waste toner 19. Thus, this simple configuration minimizes the number of necessary components.

Second Embodiment

Figure 8:
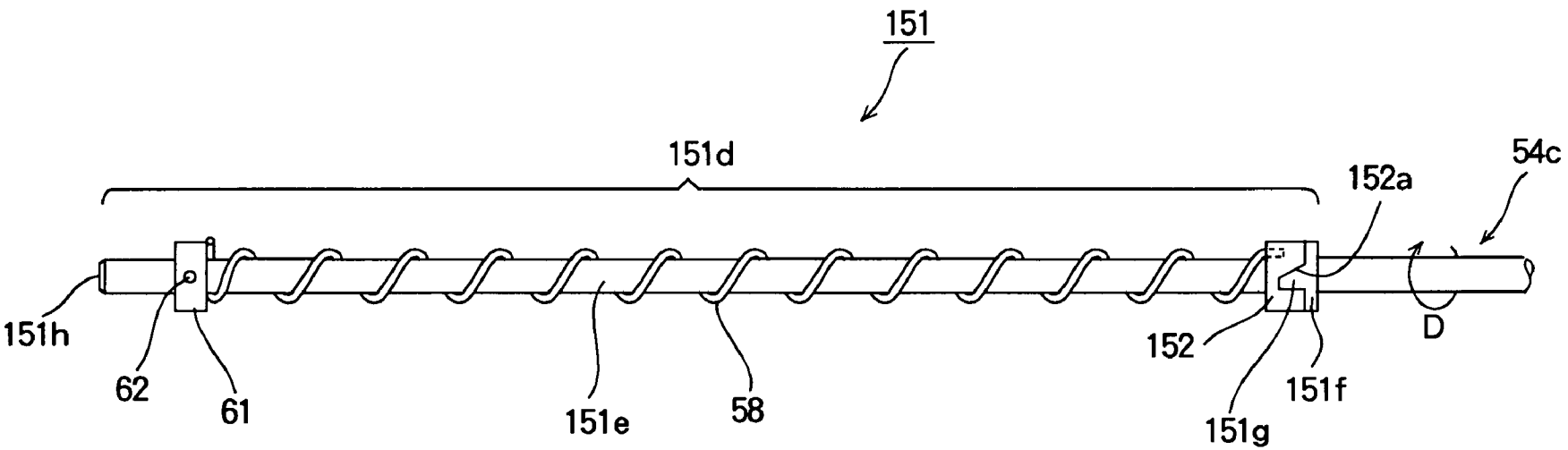
FIG. 8 is a fragmentary side view of a pertinent portion of a spiral for use in a waste toner collecting apparatus according to a second embodiment.

FIG. 8 is a fragmentary side view of a pertinent portion of a spiral 151 for use in a waste toner collecting apparatus 150 according to a second embodiment.

The waste toner collecting apparatus 150 that employs the spiral 151 differs from the waste toner collecting apparatus 51 in the configuration of a free end portion 151*d* of the spiral 151 and a method for driving the spiral 151 to rotate. Like components have been given like reference numerals and the description thereof is omitted. The second embodiment will be described primarily with reference to the difference between the first embodiment and second embodiment.

Referring to FIG. 8, the free end portion 151*d* includes a force transmitting section that is comprised of a ratchet pawl 151*f* formed in one piece with a shaft 151*e* and a ratchet wheel 152. The free end portion 151*d* also includes a second toner transporting section or coil spring 58 and fixed stopper 61. The ratchet wheel 152 is slidably mounted on the shaft 151*e*. The coil spring 58 has one end secured to the ratchet wheel 152 and another end abutting the stopper 61 such that the coil spring 58 is slidable on the surface of stopper 61. The stopper 61 is secured to the shaft 151*e* at a position somewhat away from an end 151*h* by means of a knock pin 62. In other words, the coil spring 58 and ratchet wheel 152 are integral with each other, and are positioned between the ratchet pawl 151*f* and stopper 61 with the coil spring 58 is in a compressed state. The ratchet pawl 151*f* has a projection 151*g* while the ratchet wheel 152 has a recess 152*a*, the projection 151*g* and recess 152*a* forming a ratcheting mechanism.

Figures 9A, 9B, 9C:
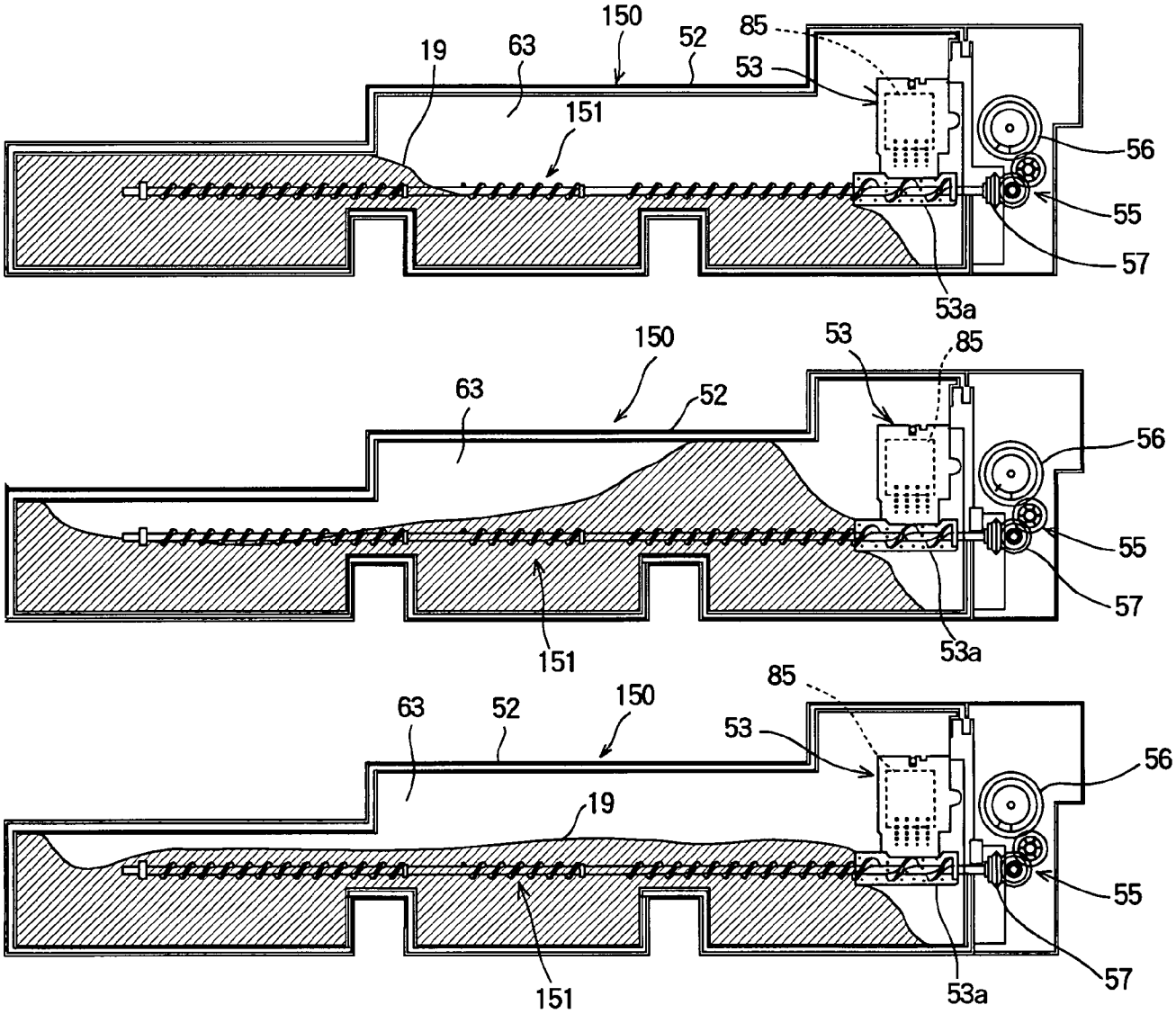
FIGS. 9A-9C are front views illustrating the toner collecting apparatus.

A waste toner collecting apparatus 150 according to the second embodiment has the aforementioned configuration. The operation of the waste toner collecting apparatus 150 will be described. FIGS. 9A-9C are front views illustrating the waste toner collecting apparatus 150.

The waste toner collecting apparatus 150 operates in the same way as the waste toner collecting apparatus 51 according to the first embodiment from the beginning of introducing the waste toner until the density of the waste toner in the toner holding space 63 increases gradually. An increase in the density of the waste toner causes the torque load exerted on the coil spring 58 to increase. At this moment, a drive force transmitted from a drive motor, not shown, is driving the spiral 151 to rotate about the X-axis in a direction shown by arrow D (FIG. 8).

When the torque load on the coil spring 58 exceeds a certain value, the ratcheting mechanism begins to operate so that the ratchet wheel 152 climbs over an inclined surface formed on the projection 151*g* of the ratchet pawl 151*f* to allow the coil spring 58 to rotate relative to the shaft 151*e* with no load exerted on the coil spring 58. After the engagement piece 52 has climbed over the inclined surface of the projection 151*g* of the ratchet pawl 151*f*, the recess 152*a* will move again into a fitting engagement with the projection 151*g*. Thus, as the spiral 151 rotates, the engagement piece 52 and ratchet pawl 151*f* cycle to move into and out of fitting engagement with each other. This causes the coil spring 58 to be more compressed and less compressed alternately, but the coil spring 58 does not rotate so that the waste toner is not transported by the spiral 151 toward the back end of the toner holding space 63.

When the torque load exerted on the coil spring 58 has not exceeded a certain value yet, the coil spring 58 continues to rotate together with the shaft 151*e*.

If the spiral 151 is rotated about the X-axis in a direction opposite to arrow D, the ratchet mechanism prevents the ratchet wheel 152 from climbing the ratchet pawl 151*f* but causes the ratchet wheel 152 to rotate together with the shaft 151*e* so that the coil spring 58 transports the waste toner away from the stopper 61.

FIG. 9B illustrates the distribution of the waste toner 19 when the spiral 151 in FIG. 9A rotates in the direction opposite to the arrow A for a certain length of time after the density of the waste toner in the toner holding space 63 had reached a certain value.

Because the spiral 151 now rotates in the opposite direction, the spiral 151 will operate to transport the waste toner 19 in the opposite direction, i.e., away from the back end portion of the toner holding space 63. This reduces the torque load exerted on the spiral 151. Thus, if the spiral 151 is rotated in the D direction (FIG. 8) again, the coil spring 58 will again transport the waste toner 19 toward the back end portion of the toner holding space 63. As a result, the waste toner 19 becomes distributed substantially uniformly across the full length of the spiral 151. It is desirable that the spiral 151 is rotated in the opposite direction to the D direction at predetermined rotation intervals.

According to the second embodiment, because the toner transporting operation of the free end portion 151*d* is stopped when the density of the waste toner at the back end portion of the toner holding space 63 exceeds a certain value, the drive motor for the spiral 151 is prevented from being overloaded. This allows the waste toner to be accommodated in a space at a lower density after the density of the waste toner at the back end portion of the toner holding space 63 has exceeded a certain value.

When the spiral 151 rotates in the D direction, if the density of the waste toner at the back end portion of the toner holding space 63 exceeds a certain value, the coil spring 58 will rotate relative to the shaft 151*e* without a load exerted on the coil spring 58. When the spiral 151 rotates in the opposite direction to the D direction, the coil spring 58 will rotate together with the shaft 151 to transport the waste toner away from the back end portion of the toner holding space 63.

Third Embodiment

Figure 10:
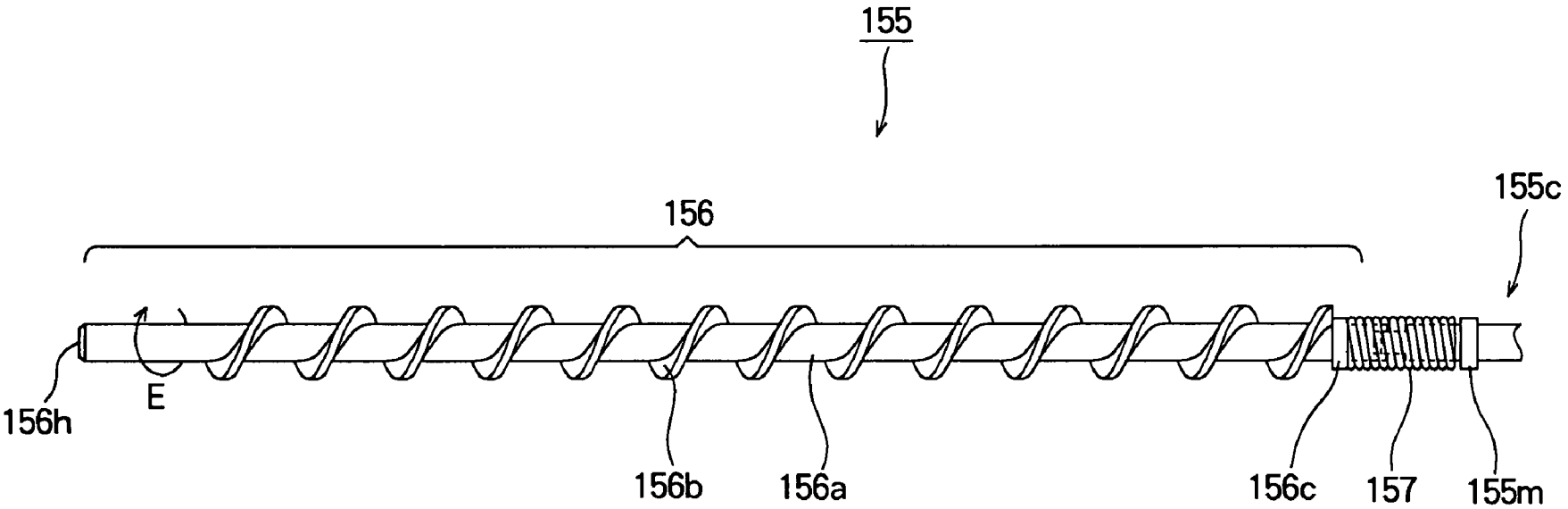
FIG. 10 is a fragmentary side view of a pertinent portion of a spiral for use in a waste toner collecting apparatus according to a third embodiment.

FIG. 10 is a fragmentary side view of a pertinent portion of a spiral 155 for use in a waste toner collecting apparatus according to a third embodiment.

The toner collecting apparatus that employs the spiral 155 differs from the waste toner collecting apparatus 51 in the configuration of a free end portion 156 and a spiral portion 155*c* and a method for driving the spiral 155 to rotate. Like components have been given like reference numerals and the description thereof is omitted. The third embodiment will be described primarily with reference to a portion different from the first embodiment (FIG. 2).

Referring to FIG. 10, unlike the spiral 54 (FIGS. 6) and the spiral 151 (FIG. 8), the spiral 155 is not in one piece construction. In other words, the free end portion 156 is a member separate from the rest of the spiral 151. The free end portion 156 is a one-piece molded plastic structure including a shaft 156*a* and a second toner transporting section or screw 156*b*. One longitudinal end of the screw 156 is somewhat away from an end 156*h*. A flange 156*c* is formed on the side of the screw 156 remote from a free end 156*h* of the shaft 156*a*. The free end portion 156 is coupled to a spiral portion 155*c* via a coil spring 157 mounted between the flange 156*c* and a flange 155*m*.

Figure 11A:
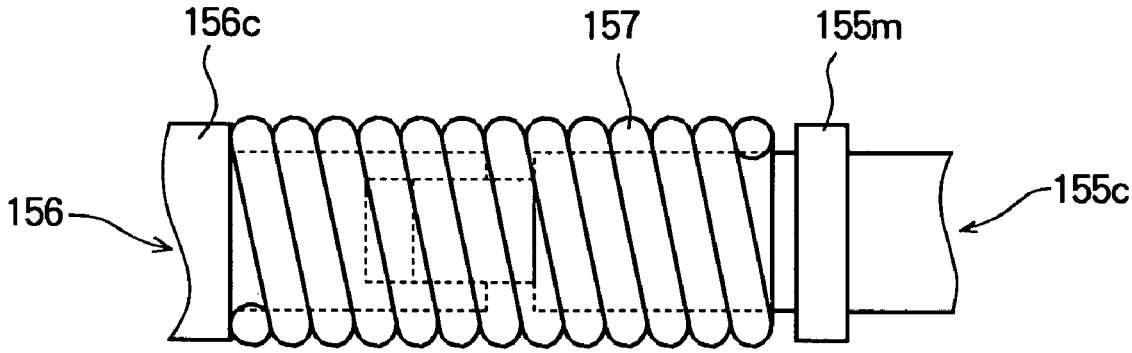
FIG. 11A is a fragmentary enlarged view of a flange, a coil spring, and another flange.
Figure 11B:
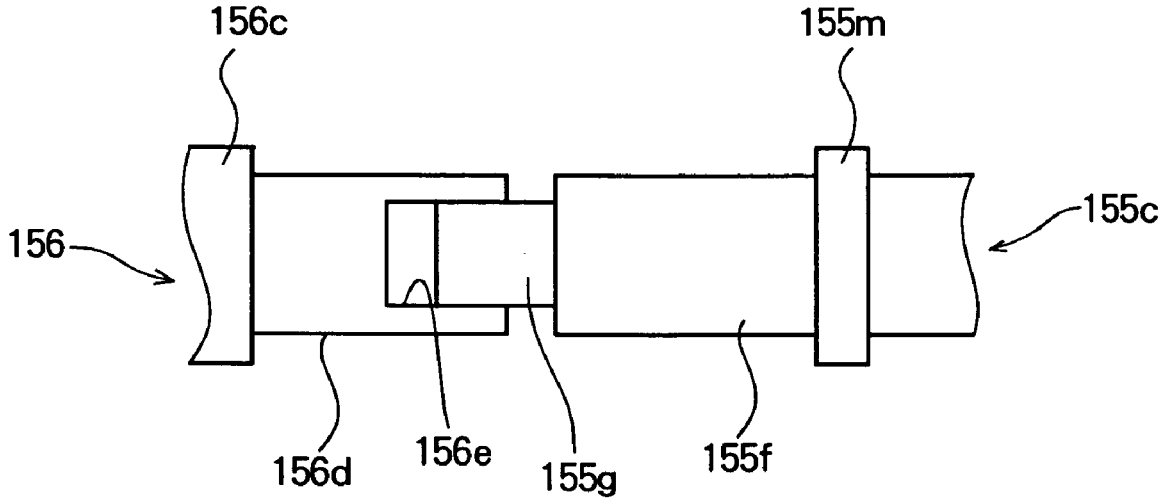
FIG. 11B is a fragmentary view illustrating the positional relation between the flange and another flange with the coil spring omitted.

FIG. 11A is a fragmentary enlarged view of the force transmitting section that includes flange 156*c*, coil spring 157, and flange 155*m*. FIG. 11B is a fragmentary view illustrating the positional relation between the flange 156*c* and flange 155*m* with the coil spring 157 omitted.

Referring to FIG. 11B, the free end portion 156 has an engagement shaft 156*d* and an engagement recess 156*e* formed in the engagement portion 156*d*. The free end portion 156 has an engagement shaft 155*f* and an engagement projection 155*g* that projects from the engagement shaft 155*f*. The engagement recess 156*e* receives the engagement projection 155*g* loosely therein.

The coil spring 157 has an inner diameter, which is the same as or slightly smaller than the outer diameter of the engagement shafts 155*f* and 156*d*. The coil spring 157 is mounted on the engagement shafts 155*f* and 156*d* in a press-fitting manner, so that the torque is transmitted from the spiral portion 155*c* to the free end portion 156*d* via the coil spring 157 that holds both the engagement shafts 155*f* and 156*d* through friction. The engagement recess 156*e* receives the engagement projection 155*g* loosely such that the engagement shafts 155*f* and 156*d* are in line with each other. The coil spring 157 spirals in a direction opposite to the direction in which the screw 156*b* spirals.

The operation of a waste toner collecting apparatus of the aforementioned configuration will be described. This waste toner collecting apparatus differs from that of the second embodiment (FIG. 9) in that the spiral 155 is used in place of the spiral 151. A description will be given with reference to FIG. 9, assuming that the spiral 155 is assembled to the waste toner collecting apparatus 150 in FIG. 9.

When the density of the waste toner is low and therefore the load on the spiral 156*b* is small, the spiral 155 rotates in a direction shown by arrow E (FIG. 10). As the density of the waste toner at the back end portion of the toner holding space 63 increases, the load on the spiral 156*b* (FIG. 10) increases gradually. Thus, the coil spring 157 receives a large force that acts in such a direction as to unwind the coil spring 157 to loosen the frictional engagement between the coil spring 157 and the engagement shafts 155*g* and 156*d*.

When the density of waste toner increases further, the inner diameter of the coil spring 157 becomes larger, so that the friction between the coil spring 157 and the engagement shaft 155*f* and 156*d* decreases. When the load on the spiral 156*b* exceeds a certain value, the force to rotate the free end portion 156 is no longer transmitted to the free end portion 156. As a result, the free end portion 156 stops rotating so that the free end portion 156 stops its toner-transporting operation.

The third embodiment has been described in terms of the coil spring 157 not secured to any of the flange 155*m* and the flange 156*c*. Instead, the coil spring 157 may be secured at least its one end to the flange 155*m* or flange 156*c*, in which case a flange to which the coil spring 157 is not secured is not required.

When the spiral 155 stops rotating, the force that acts in such a direction as to unwind the coil spring 157 no longer acts on the coil spring 157, so that the friction between the coil spring 157 and the engagement shafts 155*f* and 156*d* is developed again. This friction allows transmission of the rotational force from the engagement shaft 155*f* to the engagement shaft 156*d*. If the spiral 155 is rotated in a direction opposite to the arrow E (FIG. 10), the coil spring 157 tends to further wind to firmly hold the engagement shafts 155*f* and 156*d*, allowing the rotational force to be transmitted from the engagement shaft 155*f* to the engagement shaft 156*d*.

As described above, because the toner-transporting operation of the free end portion 156 is stopped when the density of the waste toner at the back end portion of the toner holding space 63 exceeds a certain value, the drive motor for the spiral 151 is prevented from being overloaded. This allows the waste toner to be accommodated in a space at a lower density after the density of the waste toner at the back end portion of the toner holding space 63 has exceeded a certain value.

When the spiral rotates in the E direction, the coil spring 157 will not transmit the rotational force to the free end portion 156 so that no waste toner is transported toward the back end portion of the toner holding space 63. When the spiral rotates in the opposite direction to the E direction, the coil spring 157 will transmit the rotational force to the free end portion 156 so that the waste toner can be transported away from the back end portion of the toner holding space 63 for uniform distribution of waste toner within the toner holding space 63.

The spiral 155 may be a one-piece molded structure of a plastic material and the coil spring 157 may be assembled to the spiral 155. This is a simple structure and leads to cost reduction and improvement of reliability of operation.

Fourth Embodiment

Figure 12A:
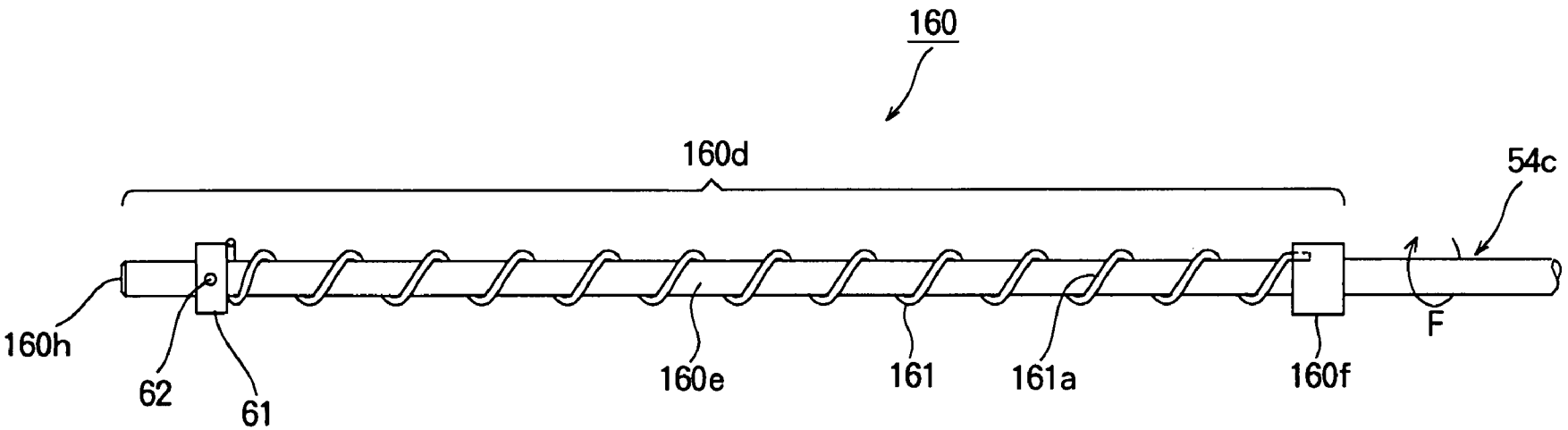
FIG. 12A is a fragmentary side view of a pertinent portion of a spiral for use in a waste toner collecting apparatus according to a fourth embodiment.
Figure 12B:
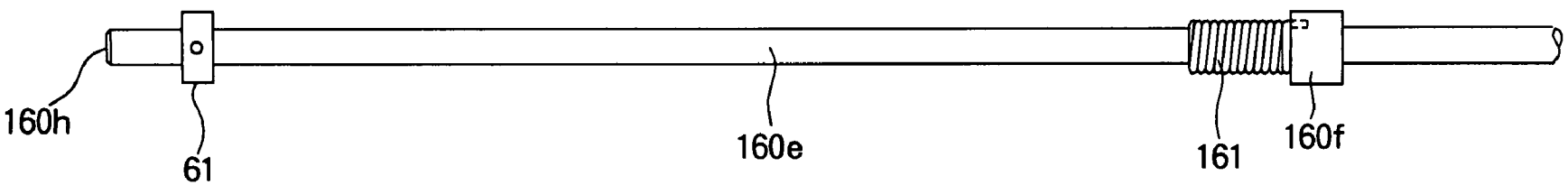
FIG. 12B illustrates the operation of the spiral.

FIG. 12A is a fragmentary side view of a pertinent portion of a spiral 160 for use in a waste toner collecting apparatus according to a fourth embodiment. FIG. 12B illustrates the operation of the spiral 160.

The toner collecting apparatus that employs the spiral 160 differs from the waste toner collecting apparatus 51 (FIG. 2) only in the configuration of a free end portion 160*d*. Like components have been given like reference numerals and the description thereof is omitted. The fourth embodiment will be described primarily with reference to a portion different from the first embodiment.

Referring to FIG. 12A, a free end portion 160*d* includes a second toner transporting section or coil spring 161*a*, stopper 61, and flange 160*f* formed in one piece construction with a shaft 160*e*. The stopper 61 is secured to the shaft 160*e* near a free end 160*h* by means of a knock pin 62. The stopper 61 is mounted at a position somewhat away from an end 160*h*. The coil spring 161 is mounted on the shaft 160*e* between the flange 160*f* and the stopper 61, and is prevented from moving toward the free end 160*h* of the shaft 160*e*. The coil spring 161 has one end secured to the flange 160*f* and another end that slides on the surface of the stopper 61. The coil spring 161 has a smaller spring constant than the coil spring 58 in the first embodiment.

The operation of the waste toner collecting apparatus that employs the spiral 160 of the aforementioned configuration will be described. This waste toner collecting apparatus differs from that of the first embodiment (FIG. 7) in that the spiral 160 is used in place of the spiral 54. A description will be given with reference to FIG. 7, assuming that the spiral 160 is assembled to the waste toner collecting apparatus 51 in FIG. 7.

When the density of the waste toner 19 is low and therefore the load on the spiral 161 (FIG. 12A) is small, the spiral 161 rotates in a direction shown by arrow F. As the density of the waste toner at the back end portion of the toner holding space 63 increases, the torque load on the spiral 161 (FIG. 12A) increases gradually. Thus, the coil spring 161 receives a large force that tends to push back the coil spring 161 toward the flange 160*f*. Because the coil spring 161 has a small spring constant, the coil spring 161 is compressed gradually as the density of the waste toner at the back end portion of the toner holding space 63 increases, so that the coil spring 161 finally becomes as short as is shown in FIG. 12B. At this stage, the coil spring 161 no longer has the ability to transport the waste toner 19.

As described above, because the toner-transporting operation of the free end portion 160*d* is stopped when the density of the waste toner at the back end portion of the toner holding space 63 exceeds a certain value, the drive motor for the spiral 160 is prevented from being overloaded. This allows the waste toner to be accommodated in a space at a lower toner density after the density of the waste toner at the back end portion of the toner holding space 63 has exceeded a certain value.

The spiral 160 may be a one-piece molded structure of a plastic material and the coil spring 161 may be assembled to the spiral 160. This simple structure requires a small number of components, and leads to cost reduction and improvement of reliability of operation.

Fifth Embodiment

Figure 13:
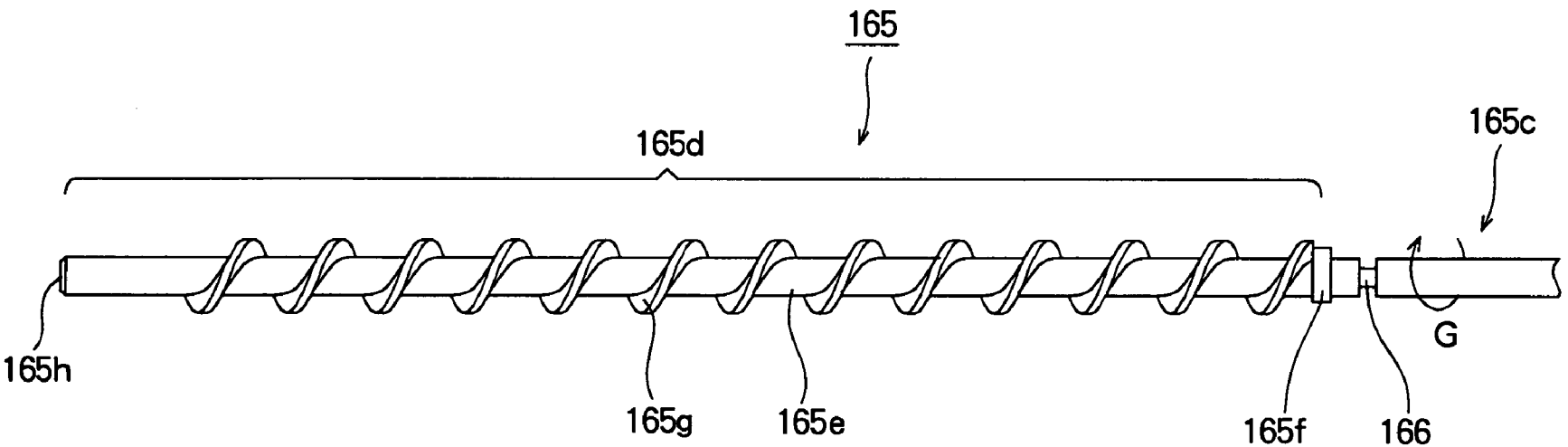
FIG. 13 is a fragmentary side view of a pertinent portion of a spiral for use in a waste toner collecting apparatus according to a fifth embodiment.

FIG. 13 is a fragmentary side view of a pertinent portion of a spiral 165 for use in a waste toner collecting apparatus according to a fifth embodiment.

The waste toner collecting apparatus that employs the spiral 165 differs from the waste toner collecting apparatus 51 (FIG. 2) only in the configuration of a spiral portion 165*c* and a free end portion 165*d*. Like components have been given like reference numerals and the description thereof is omitted. The fifth embodiment will be described primarily with reference to the difference between the first embodiment and fifth embodiment.

Referring to FIG. 13, the free end portion 165*d* has a flange 165*f*, a shaft 165*e*, and a second toner transporting section or screw 165*g*, which are all formed in one piece construction. The spiral portion 165*c* has a force transmitting section comprised of a small diameter portion 166 formed in its shaft near the flange 165*f*. The spiral 165 differs from the spiral 54 (FIG. 2) in that the small diameter portion 166 is formed near the flange 165*f*.

The operation of the waste toner collecting apparatus of the aforementioned configuration will be described. This waste toner collecting apparatus differs from that of the first embodiment (FIG. 7) in that the spiral 165 is used in place of the spiral 54. A description will be given with reference to FIG. 7, assuming that the spiral 165 has been assembled to the waste toner collecting apparatus 51 in FIG. 7.

Figure 13A:
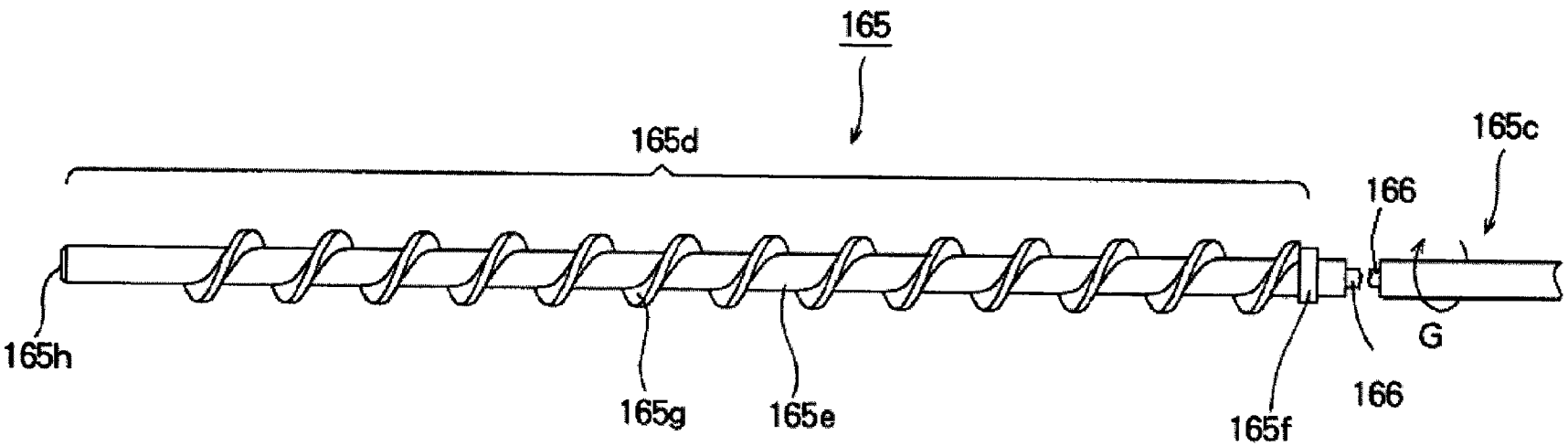
FIG. 13A is a fragmentary side view of the pertinent portion of the spiral shown in FIG. 13 with a fractured small diameter portion.

When the density of the waste toner 19 is low and therefore the load on the screw 165*g* (FIG. 13) is small, the spiral 165 rotates in a direction shown by arrow G to transport the waste toner 19 toward the back end of the toner holding space 63. As the density of the waste toner 19 at the back end portion of the toner holding space 63 increases, the load on the screw 165*g* (FIG. 13) increases. When the torque load exceeds a certain value, an increased torsional stress causes the small diameter portion 166 to fracture (see FIG. 13A). As a result, the free end portion 165*d* and the spiral portion 165*c* are broken apart, thereby stopping the operation of the free end portion 165*d* to transport the waste toner 19 into the back end portion of the toner holding space 63 any further.

Figure 14:
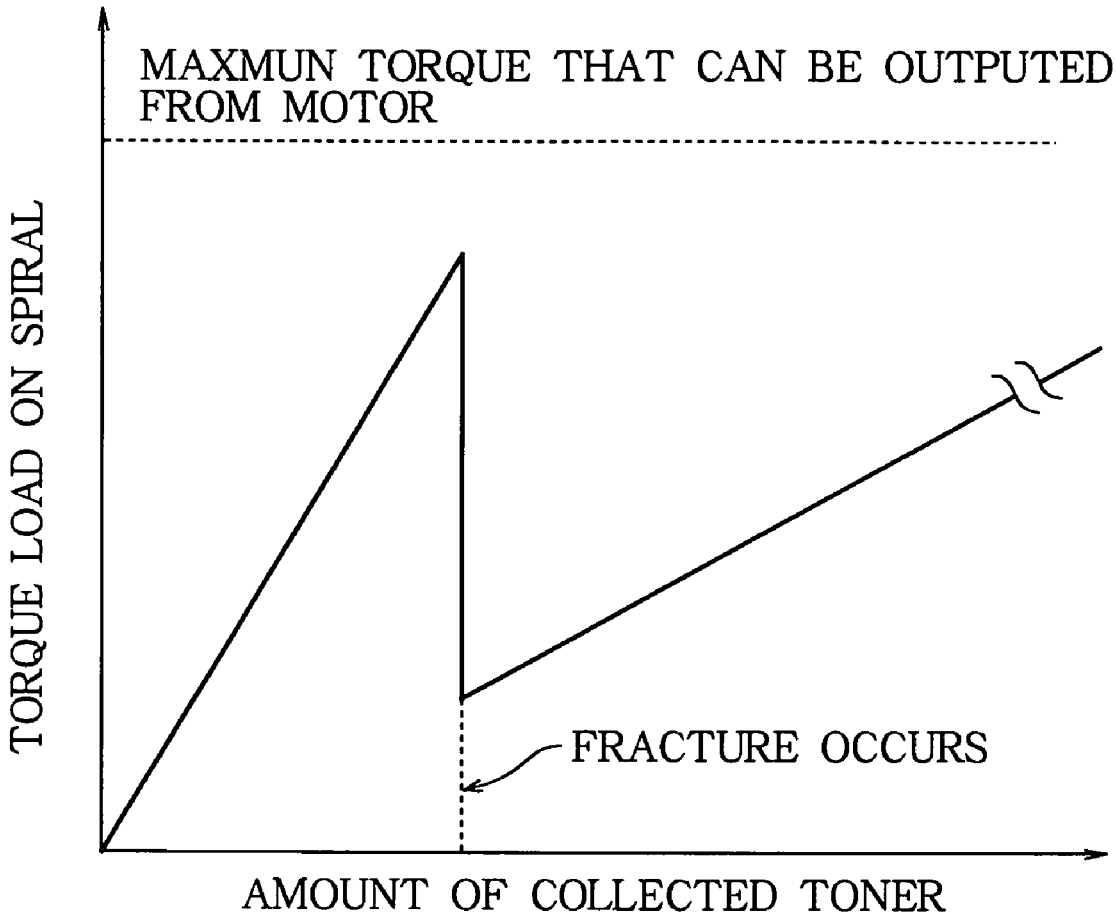
FIG. 14 is a graph of the amount of waste toner versus torque load on the spiral.

FIG. 14 is a graph of the amount of waste toner versus the torque load on the spiral 165. As is clear from FIG. 14, the torque load exerted on the free end portion 165*d* increases as the amount of the waste toner increases. Once the small diameter portion 166 fractures, the torque load exerted on the free end portion 165*d* drops to zero. This allows the drive source to drive the spiral 165 to transport the waste toner to a space in the toner collecting space 613 where the density of the waste toner is low.

As described above, because the toner-transporting operation of the free end portion 165*d* is stopped when the density of the waste toner at the back end portion of the toner holding space 63 exceeds a certain value, the drive motor for the spiral 165 is prevented from being overloaded. The fracture of the small diameter portion 166 causes the torque load on the spiral 165 to drop substantially, thereby allowing the waste toner to be accommodated more preferentially in a space at a lower toner density.

The spiral 165 can be a simple one-piece molded structure in its entirety. The configuration leads to the reduction of manufacturing cost. One-piece construction reduces the number of components, improving the reliability of the operation of the waste toner collecting apparatus.

Sixth Embodiment

Figure 15A:
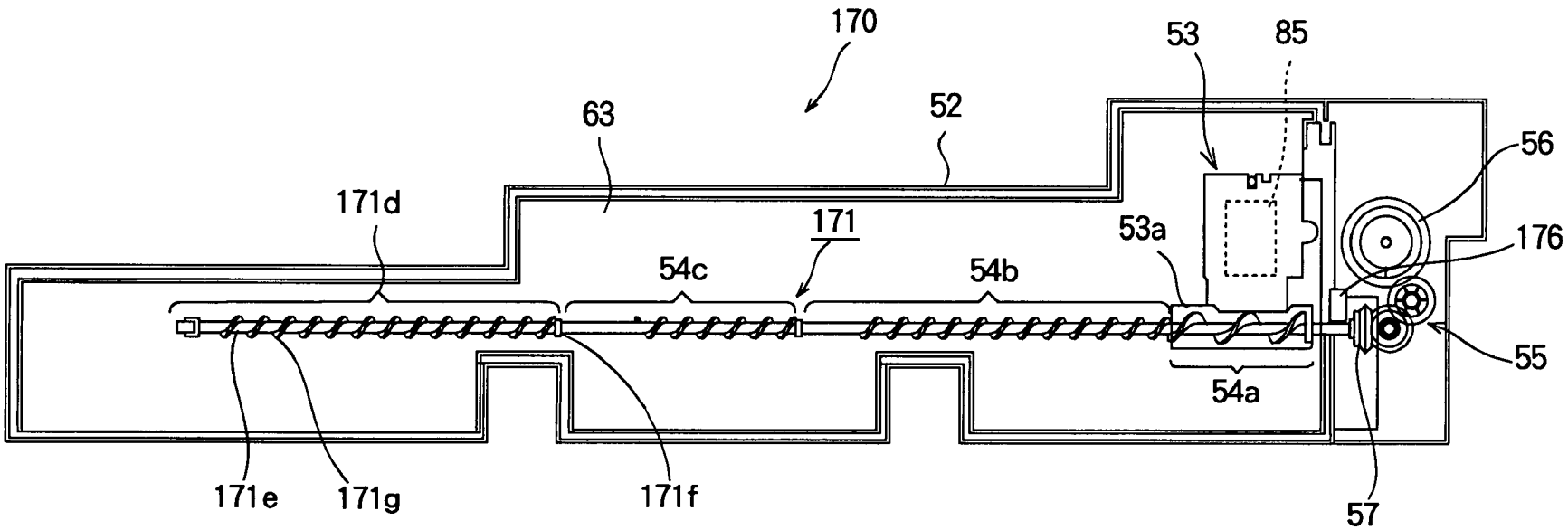
FIG. 15A is a cross-sectional side view of a waste toner collecting apparatus according to a sixth embodiment.
Figure 15B:
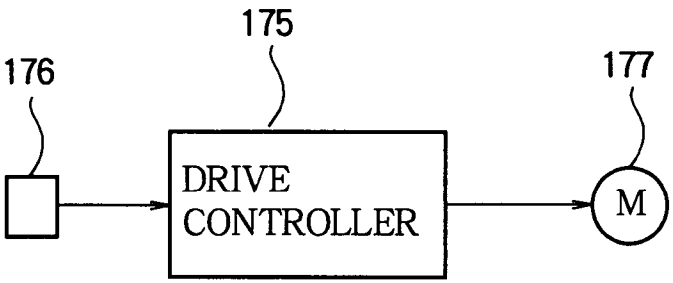
FIG. 15B is a block diagram illustrating the configuration of a control of a drive motor that drives a spiral for use in the waste toner collecting apparatus.

FIG. 15A is a cross-sectional side view of a waste toner collecting apparatus 170 according to a sixth embodiment. FIG. 15B is a block diagram illustrating the control of a drive motor that drives a spiral for use in the waste toner collecting apparatus 170.

The waste toner collecting apparatus 170 that employs the spiral 171 differs from the waste toner collecting apparatus 51 (FIG. 2) in the configuration of a free end portion 171*d* of the spiral 171 and a method for driving the spiral 171 to rotate through the use of a rotation sensor 176. Like components have been given like reference numerals and the description thereof is omitted. The sixth embodiment will be described primarily in terms of the difference between the sixth embodiment and the first embodiment.

The free end portion 171*d* includes a shaft 171*e*, a flange 171*f*, and a second toner transporting section or screw 171*g* formed about the shaft 171*e*, and is a one-piece molded structure of a plastic material just as in the spiral 54 (FIG. 2). One end portion of the spiral 171 projects outwardly of the toner holding space 63, and has a rotation sensor 176 attached thereto. The rotation sensor 176 uses a hall element and detects the rotational speed of the spiral 171.

Referring to FIG. 15B, a drive controller 175 receives rotation information from the rotation sensor 176, and controls a voltage supplied to a drive motor 177. The drive motor 177 drives the spiral 171 via a coupling 56 and a gear train 55. The drive motor 177 takes the form of a DC motor whose rotational speed changes depending on the torque load keeping the supply voltage constant.

Figure 16:
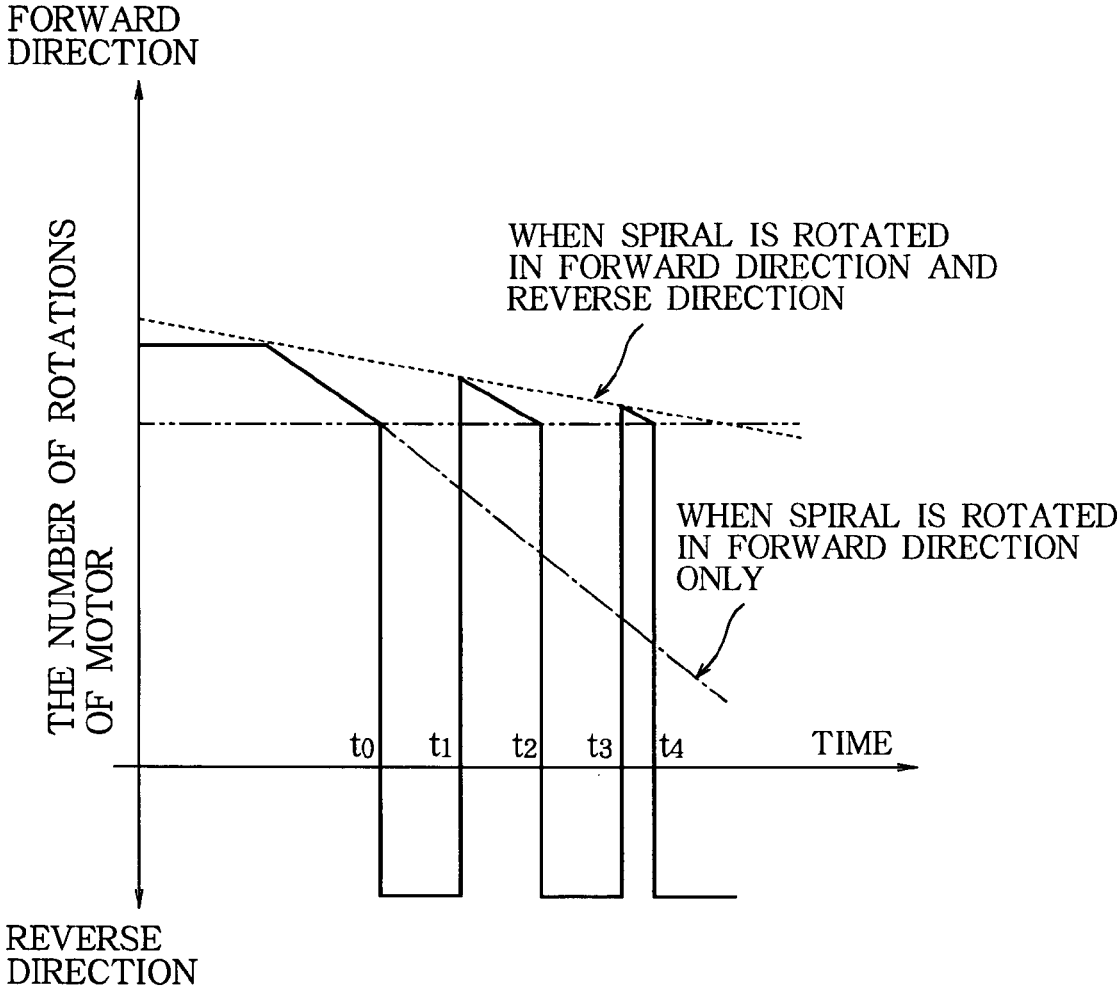
FIG. 16 is a graph of elapsed time versus rotation of the drive motor under control of the drive controller.

The method for the drive controller 175 to drive the drive motor 177 will be described. FIG. 16 is a graph of elapsed time versus rotation of the drive motor 177 under control of the drive controller 175. The forward rotation of the drive motor 177 causes the spiral 171 to rotate in a direction in which the waste toner is transported normally toward the back end portion of the toner holding space 63.

The torque load on the spiral 171 is small at an early stage of the transport of the waste toner, i.e., when the toner holding space 63 is substantially empty. At this stage, the waste toner 19 falling into the toner holding space 63 has not reached the spiral portion 54*b* of the spiral 171 as is clear from FIG. 7A.

As the waste toner 19 piles up in the back end portion of the toner holding space 63 to reach the spiral portion 54*b* of the spiral 171, the torque load exerted on the spiral 171 increases gradually and the rotational speed of the drive motor 177 decreases gradually. Then, the drive controller 175 controls the drive motor 177 to rotate in the reverse direction for a predetermined length of time beginning from the time t0 at which the rotational speed of the motor 177 decreases below a threshold. The reverse rotation of the drive motor 177 causes the waste toner, piled up excessively at the back end portion of the toner holding space 63, to move toward a space at which density of the waste toner is not so high yet. This reduces the density of the waste toner at the back end portion of the toner holding space 63. As a result, the torque load on the spiral 171 is smaller when the drive controller 175 controls the drive motor 177 to rotate in the forward direction again than immediately before the drive controller 175 begins to control the drive motor to rotate in the reverse direction. Thus, the rotational speed of the drive motor is higher when the drive controller 175 begins to control the drive motor 177 to rotate in the forward direction again than immediately before the drive controller 175 begins to control the drive motor to rotate in the reverse direction.

In this manner, every time the rotational speed of the drive motor 177 decreases below the threshold (e.g., t0, t2 and t4), the drive controller 175 controls the drive motor to rotate in the reverse direction for a predetermined length of time. Thus, the waste toner collecting apparatus 170 can accommodate the waste toner while leveling off the density of the waste toner. It is to be noted that the rate of decrease in rotational speed is lower when the reverse-rotation control is performed as shown in FIG. 16 (dotted line) than when the reverse-control is not performed as shown in FIG. 16 (dot-dash line). In this manner, the waste toner collecting apparatus 170 can accommodate as large an amount of waste toner as possible.

In the sixth embodiment, when the rotational speed of the drive motor 177 decreases below a threshold, the rotational speed of the drive motor 177 is detected and the spiral is driven to rotate in the revere direction. Alternatively, a torque sensor that can detect the torque load on the spiral may be employed, in which case, the spiral is rotated in the reverse direction when the load increases above a threshold.

In the sixth embodiment, the free end portion 171*d* includes the shaft 171*e* and the screw 171*g* formed in one piece. The free end portion 171*d* is not limited to this configuration but may be in any of the forms described in the first to fourth embodiments.

The waste toner is accommodated in the waste toner holding space 63 while leveling out the density of the waste toner throughout the toner holding space 63. This configuration allows the toner holding space 63 to hold as large an amount of waste toner as it is capable of accommodating.

Seventh Embodiment

Figure 17:
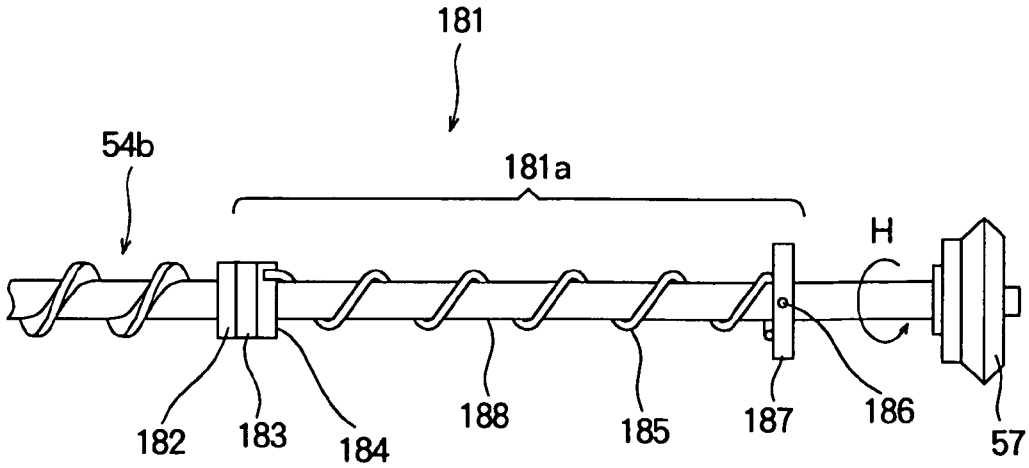
FIG. 17 is a fragmentary side view illustrating a pertinent portion of a spiral for use in a waste toner collecting apparatus according to a seventh embodiment.

FIG. 17 is a fragmentary side view illustrating a pertinent portion of a spiral 181 for use in a waste toner collecting apparatus according to a seventh embodiment.

The waste toner collecting apparatus that employs the spiral 181 differs from the waste toner collecting apparatus 170 (FIG. 15) in the configuration of a guide portion 181*a* that lies in a cylindrical sleeve 53*a* of an inlet 53. Like components have been given like reference numerals and the description thereof is omitted. The seventh embodiment will be described primarily in terms of a portion different from the sixth embodiment.

Referring to FIG. 17, the spiral 181 includes a flange 182, a washer 183, an engagement piece 184, a transporting section in the vicinity of the inlet or coil spring 185, and a fixed stopper 187, which are mounted on a shaft 188 in this order. The fixed stopper 187 is secured to the shaft 188 by means of a knock pin 186. The coil spring 185 has one end that slidably abuts the fixed stopper 187 and another end that is secured to the engagement piece 184. The coil spring 185 is a compression spring.

The operation of the waste toner collecting apparatus that employs the spiral 181 will be described. The toner collecting apparatus differs from that of the sixth embodiment 170 (FIG. 15) in that the spiral 181 is used in place of the spiral 171. A description will be given with reference to FIG. 15, assuming that the spiral 181 is assembled to the waste toner collecting apparatus 170 in FIG. 15.

When the spiral 181 is switched to rotate in the reverse direction H (FIG. 17), the spiral 181 begins to transport the waste toner toward the inlet 53. The spiral 181 rotates smoothly in the reverse direction immediately after the reverse rotation begins. However, as the density of the waste toner at the inlet 53 increases gradually, the torque load on the coil spring 185 increases gradually. When the torque load exerted on the spiral 181 exceeds a certain value, the guide portion 181*a* of the spiral 181 stops its toner-transporting operation.

In other words, when the density of the waste toner at the inlet 53 exceeds a certain value, the waste toner exerts a larger torque load on the coil spring 185 than the friction force between the flange 182 and the washer 183, the friction force between the engagement piece 184 and the washer 183, or the friction force between the coil spring 185 and the fixed stopper 187. Thus, the coil spring 185 stops rotating.

The seventh embodiment has been described with respect to the free end portion of the spiral 181 in a one-piece molded structure of a plastic material just as in the sixth embodiment. Alternatively, the free end portion of the spiral 181 may take the form of any one of the first to fourth embodiments.

The waste toner collecting apparatus according to the seventh embodiment is constructed such that when the density of the waste toner at the inlet 53 exceeds a certain value, the guide portion 181*a* of the spiral 181 stops its toner-transporting operation. This prevents the drive motor from being overloaded. This operation prevents failure of transportation of the waste toner that would otherwise occur if the spiral 181 is overloaded. Stopping the toner-transporting operation of the guide portion 181*a* of the spiral 181 will prevent back-flow of the waste toner into the toner transporting mechanism 105 of the image forming apparatus 200 in FIG. 1.

The spirals according to the first, second, and fourth embodiments include a free end portion with a coil spring that stops its toner-transporting operation when the torque load on the spiral exceeds a certain value. Alternatively, such a coil spring may be provided on the other spiral portions.

The means for transporting the waste toner according to the respective embodiments is a combination of a shaft and a toner-conveying member such as a screw or a coil spring. Alternatively, a plurality of transporting belts may be coupled together in the toner holding space, and a certain, selected belt may be stopped running as required.

While the waste toner collecting apparatus extends horizontally in a longitudinal direction and has a toner inlet formed in its one longitudinal end portion, the toner inlet may be formed at a portion other than the longitudinal end portion.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A toner-collecting apparatus comprising:

a toner collecting chamber that holds toner therein;

an inlet through which said toner collecting chamber receives the toner; and a toner transporting member located in said toner collecting chamber and transporting the toner in said toner collecting chamber, said toner transporting member including a first transporting section and a second transporting section; and a force transmitting section positioned between the first and second transporting sections transmitting a drive force from the first transporting section to the second transporting section;

wherein the ability of said toner transporting member to transport the toner decreases with increasing load on said toner transporting member exerted by the toner.

2. The toner-collecting apparatus according to claim 1, wherein said toner transporting member extends in said toner collecting chamber from upstream to downstream with respect to a direction in which the toner is transported in said toner collecting chamber, wherein the second transporting section extends from a substantially downstream end of said toner transporting member to an upstream portion of said toner transporting member.

3. The toner-collecting apparatus according to claim 1, wherein said force transmitting section ceases to transmit the drive force to the second transporting section from the first transporting section when a sufficient force is exerted on the second transporting section by the toner.

4. The toner-collecting apparatus according to claim 1, wherein said toner transporting member includes a shaft that extends in said toner collecting chamber and rotates about a longitudinal axis.

5. The toner-collecting apparatus according to claim 4, wherein said toner transporting member includes an engagement portion fixed on the shaft, and the second transporting section is in frictional contact with the engagement portion so that rotation of the shaft is transmitted to the second transporting section through a frictional force.

6. The toner-collecting apparatus according to claim 5, wherein the second transporting section is a coil spring through which the shaft extends, the coil spring urges against the engagement portion to create the frictional force.

7. The toner-collecting apparatus according to claim 4, wherein the second transporting section is coupled to the first transporting section via a ratcheting mechanism provided at the boundary between the first transporting section and the second transporting section;

wherein rotation of the first transporting section is transmitted to the second transporting section through the ratcheting mechanism.

8. The toner-collecting apparatus according to claim 7, wherein the second transporting section is a coil spring through which the shaft extends, the coil spring urges the ratcheting mechanism into an engagement state in which rotation of the first transporting section is transmitted to the second transporting section.

9. The toner-collecting apparatus according to claim 4, wherein the first transporting section includes a spiral screw that spirals on the shaft.

10. The toner-collecting apparatus according to claim 4, wherein the force transmitting section has a portion having a smaller mechanical strength than any of the first transporting section and the second transporting section, wherein the first transporting section and the second transporting section are broken apart at the force transmitting section when the second transporting section receives a torque load greater than a certain value during rotation of said toner transporting member.

11. The toner-collecting apparatus according to claim 4, wherein said toner transporting member includes an engagement portion fixed on the shaft, wherein the second transporting sections is a coil spring having one end connected to the engagement portion so that the coil spring is rotatable together with the shaft, wherein the coil spring is compressed as a torque load exerted by the toner increases.

12. The toner-collecting apparatus according to claim 1, wherein the force transmitting section includes a coil spring that is in friction engagement with the first transporting section and the second transporting section such that rotation of the first transporting section is transmitted to the second transporting section through the coil spring, wherein with increasing load on the second transporting section exerted on the second transporting section by the toner, continued rotation of the first transporting section causes the coil spring to unwind.

13. A toner-collecting apparatus comprising:

a toner collecting chamber that holds toner therein;

an inlet through which said toner collecting chamber receives the toner;

a toner transporting member located in said toner collecting chamber, said toner transporting member transporting the toner received through said inlet into said toner collecting chamber; and a direction switching section that switches a direction in which toner transporting member transports the toner in the toner collecting chamber, the direction being switched in accordance with an amount of toner in said toner collecting chamber based on a load exerted on the toner transporting member by the toner so that the toner is transported either in a first direction or in a second direction opposite to the first direction.

14. The toner-collecting apparatus according to claim 13, wherein said toner transporting member has a toner-transporting ability that changes in accordance with a condition of the toner held in said toner collecting chamber.

15. The toner-collecting apparatus according to claim 14, wherein the toner-transporting ability is constrained in a specific direction.

16. The toner-collecting apparatus according to claim 13, wherein said toner transporting member includes a shaft that extends in the toner collecting chamber and rotates about a longitudinal axis; and a toner transporting element formed about the shaft, said toner transporting element transporting the toner when the shaft rotates.

17. The toner-collecting apparatus according to claim 16, wherein said direction switching section includes a drive motor that drives the shaft in rotation;

a load detecting section that detects a torque load exerted on the shaft;

wherein said direction switching section switches a direction in which the drive motor rotates, the direction being switched depending on the torque load detected by said load detecting section.

18. The toner-collecting apparatus according to claim 17, wherein said load detecting section detects the torque load based on a rotational speed of the shaft.

19. The toner-collecting apparatus according to claim 17, wherein said toner transporting member includes a transporting section provided at least in the vicinity of the inlet.

20. An image forming apparatus incorporating said toner collecting apparatus according to claim 1, the image apparatus comprising:

a toner transporting mechanism that collects toner scraped off from a photoconductor on which a toner image is formed;

wherein said toner collecting apparatus receives the toner discharged from said toner transporting mechanism, the toner being received through an inlet of said toner collecting apparatus.

21. An image forming apparatus incorporating said toner collecting apparatus according to claim 4, the image apparatus comprising:

a toner transporting mechanism that collects toner scraped off from a photoconductor on which a toner image is formed;

wherein said toner collecting apparatus receives the toner discharged from said toner transporting mechanism, the toner being received through an inlet of said toner collecting apparatus.

22. The toner-collecting apparatus according to claim 1, wherein the drive force is a torque exerted on the toner transmitting member.

23. The toner-collecting apparatus according to claim 12, wherein when the coil spring unwinds, a diameter of the coil spring increases allowing the first transporting section to rotate relative to the second transporting section.

24. The toner-collecting apparatus according to claim 19, wherein the transporting section in the vicinity of the inlet ceases to transport toner toward the inlet when the toner transporting member is rotated in the second direction and a sufficient force is exerted on the toner transporting member by the toner in the vicinity of the inlet.

* * * * *